US006883448B2

(12) United States Patent
Sakakibara et al.

(10) Patent No.: US 6,883,448 B2
(45) Date of Patent: Apr. 26, 2005

(54) SEWING APPARATUS AND INFORMING CONTROL PROGRAM THEREFOR

(75) Inventors: Kaoru Sakakibara, Moriyama-ku (JP); Akira Kaiya, Mizuho-ku (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 98 days.

(21) Appl. No.: 10/623,728

(22) Filed: Jul. 22, 2003

(65) Prior Publication Data

US 2004/0200395 A1 Oct. 14, 2004

(30) Foreign Application Priority Data

Jul. 22, 2002 (JP) ..... 2002-212380

(51) Int. Cl.[7] ..... D05B 19/12
(52) U.S. Cl. ..... 112/470.01; 112/254; 112/453
(58) Field of Search ..... 112/470.01, 270, 112/302, 225, 453, 457, 254; 700/136, 137, 138

(56) References Cited

U.S. PATENT DOCUMENTS 6,769,371 B2 * 8/2004 Sakakibara et al. .... 112/470.01
6,779,470 B2 * 8/2004 Sakakibara et al. .... 112/470.01

FOREIGN PATENT DOCUMENTS

JP 2002-91558 * 3/2002
JP 2002-189517 * 6/2002

* cited by examiner

*Primary Examiner*—Peter Nerbun
(74) *Attorney, Agent, or Firm*—Oliff & Berridge, PLC

(57) ABSTRACT

A sewing apparatus such as a sewing machine includes a cassette mount to which a thread cassette having a thread accommodating section for accommodating a thread supply is detachably attached, at least one detector detecting an operating state of at least one mechanism related with the thread cassette, a determining unit determining whether the thread cassette can be attached to the cassette mount, based on a result of detection by the detector, and an informing unit informing a result of determination by the determining unit.

13 Claims, 24 Drawing Sheets

SEWING APPARATUS AND INFORMING CONTROL PROGRAM THEREFOR

BACKGROUND OF THE INVENTION

1. Field of the invention

This invention relates to a sewing apparatus provided with a cassette mount to which a thread cassette is detachably attached and an informing control program for such a sewing apparatus.

2. Description of related art

Sewing apparatus have conventionally been provided including a cassette mount to which a thread cassette is detachably attached. The thread cassette accommodates a thread spool on which a thread is wound. The thread drawn from the thread cassette serves as a needle thread. The thread drawn from the thread cassette attached to the cassette mount is caused to extend between a pair of thread tension discs and then caught by a needle thread take-up lever. The thread is further caused to pass through a hole of a sewing needle mounted to a needle bar, thereby being set. The assignee of the present application filed a Japanese patent application to which application No. 2002-91558 has been assigned. This Japanese patent application discloses a sewing apparatus including a thread feeding mechanism operated in synchronization with attachment of the thread cassette to the cassette mount, and a threading mechanism. The thread drawn from the thread cassette is automatically passed through the needle hole by the thread feeding mechanism and threading mechanism.

In the foregoing sewing apparatus, the thread feeding mechanism includes a thread catching member and a moving mechanism for moving the thread catching member. Upon actuation of the thread feeding mechanism, the thread catching member is lowered so that the thread drawn from the thread cassette is caught by the thread catching member. The thread is carried near the needle hole and then tensioned in front of the needle hole. The threading mechanism comprises a threading shaft provided along the needle bar so as to be moved up and down and further rotated and a threading hook mounted on a lower end of the threading shaft so as to be allowed to pass through the needle hole. Upon actuation of the threading mechanism, the threading shaft is lowered to be positioned relative to the needle bar and then stopped. Successively, the threading shaft is rotated so that the threading hook is passed through the needle hole. The thread drawn from the thread cassette has been carried near the needle hole by the thread catching member. The thread is caught by the threading hook having been passed through the needle hole and subsequently, the threading shaft is rotated in the reverse direction so as to be pulled out of the needle hole.

In the sewing apparatus of the above-described type, the needle bar is moved up and down relative to an arm portion of the sewing apparatus by a needle bar vertically moving mechanism and is rocked right and left by a needle bar rocking mechanism. In this case, the needle bar and the threading mechanism are mounted on a needle bar frame pivotally mounted on a frame of the arm, so that the needle bar is stopped at any vertical position and at any zigzag position. On the other hand, the aforesaid thread feeding mechanism is mounted on the frame of the arm, and the thread drawn from the thread cassette is carried to a fixed position relative to the arm.

Accordingly, in order that a threading operation may be carried out desirably by the aforesaid threading mechanism and thread feeding mechanism, the needle bar, threading mechanism and thread feeding mechanism need to be in a proper positional relationship at the time of the threading operation or in other words, the needle bar needs to be located at a predetermined vertical position and a predetermined zigzag position. Furthermore, a pair of thread tension discs need to be in an open state when the sewing apparatus is constructed so that the thread drawn from the thread cassette is held between the thread tension discs in synchronization with attachment of the thread cassette to the cassette mount.

More specifically, the aforesaid sewing apparatus, wherein the thread is set in synchronization with attachment of the thread cassette to the cassette mount, has two conditions. In one condition, the thread cassette may be attached to the cassette mount and in the other condition, the thread cassette should not be attached to the cassette mount. However, the user has a difficulty in determining whether the thread cassette can be attached to the cassette mount, viewing a zigzag position of the needle bar or the like. Furthermore, the user could try to attach the thread cassette to the cassette mount without giving due consideration to whether the thread cassette can be attached. Accordingly, there is a possibility that the user may attach the thread cassette to the cassette mount although the sewing machine is in the condition where the thread cassette should not be attached. If the thread cassette should be attached in this condition, threading could not be carried out successfully by the threading mechanism since a vertical position or zigzag position of the needle bar relative to the thread feeding mechanism would be shifted or in the worst case, the threading mechanism would be damaged.

Furthermore, when the thread cassette is attached to the cassette mount with the paired thread tension discs being closed, the thread cannot be caught between the discs. As a result, the thread cannot be set properly. Alternatively, for example, when the sewing apparatus is provided with a sensor which needs to be checked in its initial state without the thread cassette being attached, the thread cassette is attached to the cassette mount before the sensor is checked, whereupon a failure may occur in the sewing apparatus.

SUMMARY OF THE INVENTION

Therefore, an object of the present invention is to provide a sewing apparatus which can inform a user whether the thread cassette can be attached to the cassette mount, so that attachment of the thread cassette can be prevented in the case where the thread cassette should not be attached, and an informing control program applicable to the sewing apparatus.

The present invention provides a sewing apparatus having a cassette mount to which a thread cassette having a thread accommodating section for accommodating a thread supply is detachably attached. The sewing apparatus comprises at least one detector detecting an operating state of at least one mechanism related with the thread cassette, a determining unit determining whether the thread cassette can be attached to the cassette mount, based on a result of detection by the detector, and an informing unit informing a result of determination by the determining unit.

The operating state of the mechanism related with the thread cassette is detected by the detector. Based on the detected operating state, the determining unit automatically determines whether the thread cassette can be attached to the cassette mount. The informing unit informs the result of determination by the determining unit. Accordingly, since the user can get information about whether the thread cassette can be attached to the cassette mount, he or she can attach the thread cassette to the cassette mount when it can be attached, according to the information. Consequently, attachment of the thread cassette can be prevented when the thread cassette should not be attached and accordingly, occurrence of failure due to the attachment can be prevented.

The aforesaid mechanism having the operative connection with the thread cassette includes a threading mechanism threading the needle hole, a needle bar vertically moving mechanism, a needle bar rocking mechanism, a thread tensioning mechanism adjusting a tension of the thread drawn from the thread cassette, a bobbin thread winding mechanism winding the thread from a supply of thread on a thread winding member such as a bobbin, and a sensor, for example. The sewing apparatus can be constructed so that the detector detects the operating state of one or more of these mechanisms.

Japanese patent application No. 2002-91558 filed by the assignee of the present application discloses a structure of the aforesaid threading mechanism in detail. U.S. patent application Ser. No. 10/392,186 corresponds to the above-noted Japanese patent application. Furthermore, the thread cassette may be attached to and detached from the cassette mount completely manually. Alternatively, rubber rollers may be provided in the cassette mount to be driven so that the thread cassette is moved into and out of the cassette mount, as disclosed by Japanese patent application No. 2002-189517 filed by the assignee of the present application.

When the sewing apparatus includes a threading mechanism for passing, through a hole of a sewing needle, a thread drawn from the thread cassette attached to the cassette mount, the aforesaid detector preferably includes a threading detector detecting a state of a mechanism affecting executability of a threading operation by the threading mechanism. When the thread can be passed through the hole of the needle, the determining unit may determine that the thread cassette can be attached to the cassette mount, on the basis of a result of detection by the threading detector.

In the above-described construction, when the threading mechanism can thread the needle, it is determined that the thread cassette can be attached to the cassette mount. Thus, since the user can be informed of allowability of attachment, he or she can attach the thread cassette to the cassette mount under a condition where the threading operation can properly be executed. Furthermore, attachment of the thread cassette by the user can be prevented when the mechanism affecting executability of the threading operation by the threading mechanism is unsuitable for the cassette attachment.

When the sewing apparatus includes a needle bar vertically moving mechanism for moving the needle bar vertically, the aforesaid detector preferably includes a needle bar vertical position detector detecting a vertical position of the needle bar. When the needle bar is at a predetermined vertical position, the determining unit preferably determines that the thread cassette can be attached to the cassette mount, based on a result of detection by the needle bar vertical position detector.

In the above-described construction, when the needle bar is at the predetermined vertical position, it is determined that the thread cassette can be attached to the cassette mount. Thus, since the user can be informed of allowability of attachment, he or she can attach the thread cassette to the cassette mount under a condition where the vertical position of the needle bar is proper. Furthermore, attachment of the thread cassette by the user can be prevented when the vertical position of the needle bar is unsuitable for the cassette attachment.

When the sewing apparatus includes a needle bar rocking mechanism rocking the needle bar, the aforesaid detector preferably includes a zigzag position detector detecting a zigzag position of the needle bar. When the needle bar is at a predetermined zigzag position, the determining unit preferably determines that the thread cassette can be attached to the cassette mount, based on a result of detection by the zigzag position detector.

In the above-described construction, when the needle bar is at the predetermined zigzag position, it is determined that the thread cassette can be attached to the cassette mount. Thus, since the user can be informed of allowability of attachment, he or she can attach the thread cassette to the cassette mount under a condition where the zigzag position of the needle bar is proper. Furthermore, attachment of the thread cassette by the user can be prevented when the zigzag position of the needle bar is unsuitable for the cassette attachment.

When the sewing apparatus includes a thread tensioning mechanism adjusting a thread tension of the thread drawn from the thread cassette, the aforesaid detector preferably includes a thread tension detector detecting an open or closed state of the thread tensioning mechanism. When the thread tensioning mechanism is open, the determining unit preferably determines that the thread cassette can be attached to the cassette mount, based on a result of detection by the thread tension detector.

In the above-described construction, when the thread tensioning mechanism is in the open state, it is determined that the thread cassette can be attached to the cassette mount. Thus, since the user can be informed of allowability of attachment, he or she can attach the thread cassette to the cassette mount under a condition where the thread tensioning mechanism is proper. Furthermore, attachment of the thread cassette by the user can be prevented when the thread tensioning mechanism is closed and unsuitable for the cassette attachment.

The sewing apparatus preferably further comprises a needle bar rocking mechanism, a thread tensioning mechanism adjusting a tension of the thread drawn from the thread cassette, and a single driving mechanism driving both needle bar rocking mechanism and thread tensioning mechanism. The aforesaid detector preferably includes a zigzag position detector detecting a zigzag position of the needle bar and a thread tension detector detecting an open or closed state of the thread tensioning mechanism. The zigzag position of the needle bar and the open or closed state of the thread tensioning mechanism are preferably detected on the basis of a drive amount of the driving mechanism.

In the above-described construction, both the zigzag position of the needle bar and the open or closed state of the thread tensioning mechanism are detected on the basis of a drive amount of the common driving mechanism driving the needle bar rocking mechanism and the thread tensioning mechanism. Thus, allowability of attachment of the thread cassette is determined and informed of. Consequently, the user can attach the thread cassette to the cassette mount under a condition where both the zigzag position of the needle bar and the open or closed state of the thread tensioning mechanism are proper. Furthermore, attachment of the thread cassette by the user can be prevented when at least either the zigzag position of the needle bar or the open or closed state of the thread tensioning mechanism is unsuitable for the cassette attachment. In this case, since the operating states of two mechanisms are commonly detected, the arrangement of the detector can be simplified. The mechanical structure of the sewing apparatus can also be simplified as compared with the case where the needle bar rocking mechanism and the thread tensioning mechanism are provided with respective drive sources.

The sewing apparatus preferably further comprises a sewing machine motor, a bobbin, a bobbin thread winding shaft on which the bobbin is mounted and a bobbin thread winding mechanism transmitting a driving force of the sewing machine motor to the bobbin thread winding shaft so that a bobbin thread is wound on the bobbin. In this case, the aforesaid detector preferably includes a thread winding detector detecting an operating state of the bobbin thread winding mechanism. When the bobbin thread winding mechanism is in operation, the determining unit determines that the thread cassette can be attached to the cassette mount, based on a result of detection by the thread winding detector.

In the above-described construction, when the sewing machine motor is being driven and the driving force of the motor is being used for operation of the bobbin thread winding mechanism, it is determined that the thread cassette can be attached to the cassette mount. Thus, since allowability of attachment of the thread cassette is informed of, the user can attach the thread cassette to the cassette mount in a proper condition where the needle bar vertically moving mechanism is not in operation. Furthermore, attachment of the thread cassette by the user can be prevented when the sewing machine motor is being driven.

The informing unit is preferably provided with a display unit displaying whether the thread cassette can be attached to the cassette mount. The display unit is preferably disposed near the cassette mount. In this case, the user attaches the thread cassette, while viewing the cassette mount. Accordingly, the user tends to pay attention to the displayed contents of the display unit. Consequently, allowability of attachment of the thread cassette can clearly be informed of.

The sewing apparatus preferably further comprises a cassette detector detecting the thread cassette having been attached to the thread cassette. The informing unit stops informing that the thread cassette can be attached, when attachment of the thread cassette to the cassette mount has been detected by the cassette detector. Consequently, attachment of the thread cassette can clearly be informed of by the stop of the informing operation.

The informing unit is preferably provided with a lamp unit which changes a color of light, thereby informing whether the thread cassette can be attached to the cassette mount. Consequently, allowability of attachment of the thread cassette can clearly be informed of by the change of light color.

The sewing apparatus preferably further comprises a cassette detector detecting the thread cassette having been attached to the thread cassette. In this construction, the informing unit preferably turns off the lamp when attachment of the thread cassette to the cassette mount has been detected by the cassette detector. Consequently, attachment of the thread cassette can clearly be informed of by turn-off of the lamp.

The informing unit preferably informs whether the thread cassette can be attached to the cassette mount, by means of a character message. In this case, too, allowability of attachment of the thread cassette can clearly be informed of.

The invention also provides an informing control program for a sewing apparatus including a cassette mount to which a thread cassette having a thread accommodating section for accommodating a thread supply is detachably attached and at least one detector detecting an operating state of at least one mechanism related with the thread cassette, the program informing, on a computer, whether the thread cassette can be attached to the cassette mount. The program accomplishes the functions of a determining unit determining whether the thread cassette can be attached to the cassette mount, based on a result of detection by the detector, and an informing unit informing a result of determination by the determining unit.

The informing control program is applied to a computer incorporated in the sewing apparatus. The operating state of the mechanism related with the thread cassette is detected by the detector. Based on the detected operating state, the determining unit automatically determines whether the thread cassette can be attached to the cassette mount. The informing unit informs the result of determination by the determining unit. Accordingly, since the user can get information about whether the thread cassette can be attached to the cassette mount, he or she can attach the thread cassette to the cassette mount when it can be attached, according to the information. Consequently, attachment of the thread cassette can be prevented when the thread cassette should not be attached and accordingly, occurrence of failure due to the attachment can be prevented. The above-described informing control program may be supplied to users via communication means such as the internet or the like, or may be recorded on a recording medium such as CD, MD or FD to be supplied to the users with the recording medium.

BRIEF DESCRIPTION OF THE DRAWINGS

Other objects, features and advantages of the present invention will become clear upon reviewing the following description of embodiments, made with reference to the accompanying drawings, in which.

DETAILED DESCRIPTION OF THE INVENTION

Figure 1:
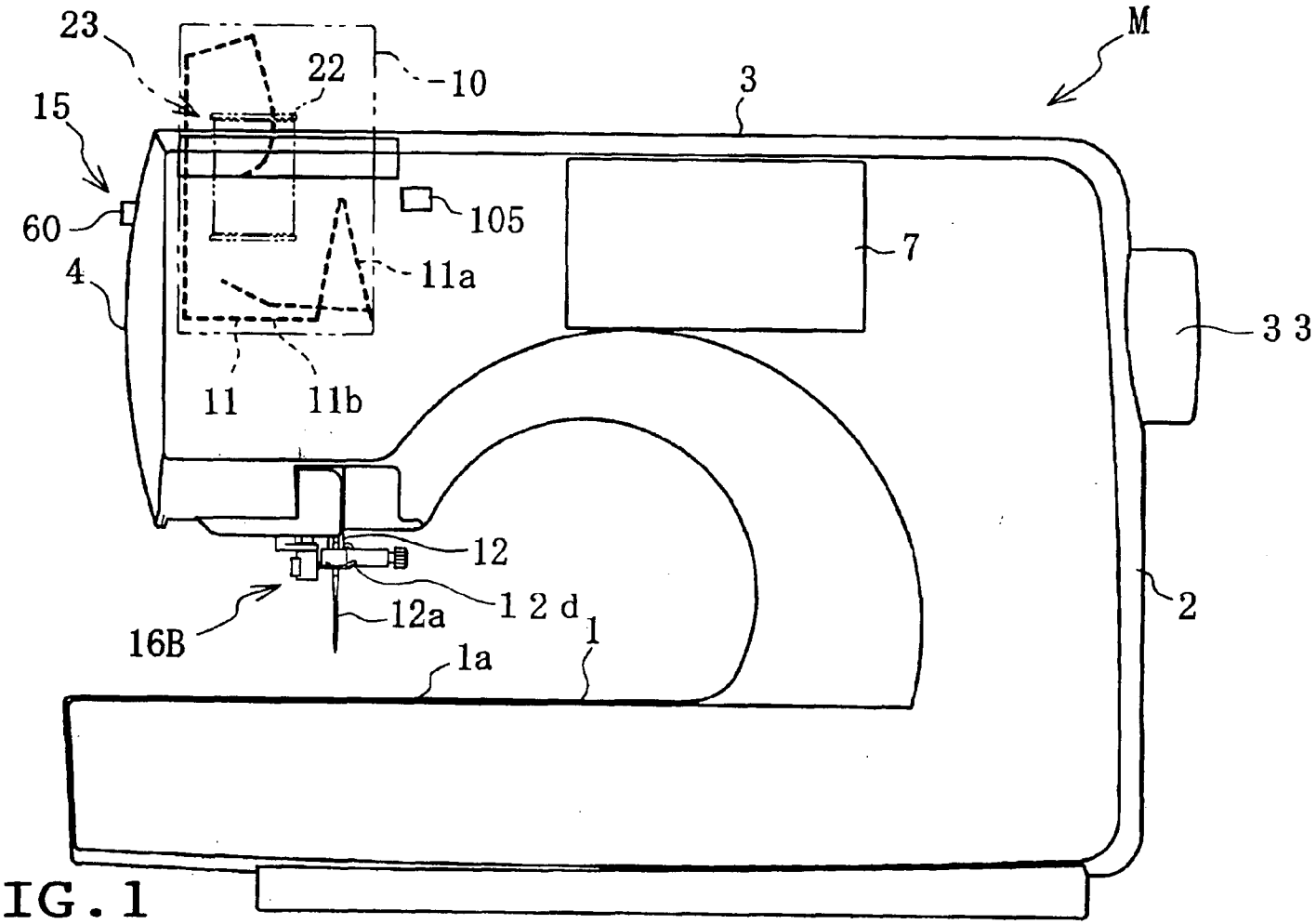
FIG. 1 is a front view of a sewing machine in accordance with a first embodiment of the present invention, showing a condition where a thread cassette is being attached to a cassette mount.

A first embodiment of the present invention will be described with reference to FIGS. 1 to 21. The invention is applied to a household sewing machine provided with a cassette mount to which a thread cassette with a thread accommodating section for accommodating a supply of thread is detachably attached.

Referring to FIGS. 1 to 4, the household sewing machine M includes a sewing bed 1 having a horizontal plane, a pillar 2 standing from a right end of the bed 1, a sewing arm 3 extending leftward from an upper end of the pillar 2 so as to be opposed along the bed 1 and a machine head 4 located at a left end of the arm 3. The head 4 is provided with a cassette mount 5 to which a thread cassette 10 is detachably attached. A thread 11 drawn from the thread cassette 10 attached to the cassette mount 5 serves as a needle thread. The arm 3 or the head 4 thereof includes operation switches 6 (only shown in FIG. 17) such as a start/stop switch, a needle vertically moving switch, a threading switch, etc. The arm 3 further includes a liquid crystal display 7. A touch panel 8 (see FIG. 17) is provided on the surface of the display 7. LED 105 is provided on the front face of the arm 3 on the right of the cassette mount so as to be located near the cassette mount. LED 105 serves as a part of an informing unit as will be described in detail later. The arm 3 is provided with a bobbin thread winding mechanism.

Referring to FIGS. 2, 4, 9 and 10, in the head 4 are provided a needle bar 12 having a lower end to which a sewing needle 12*a* is mounted, a needle thread take-up 13 moved vertically in synchronization with the need bar so that the thread is tensioned, a thread tensioning mechanism 14 adjusting a tension of the thread 11 drawn from the thread cassette 10 attached to the cassette mount 5. In the head 14 are further provided a thread tension releasing mechanism 15 rendering the thread tensioning mechanism 14 open when an ejection operating member 60 is operated, a thread feeding mechanism 16A, a threading mechanism 16B and a thread guiding mechanism 17 each operated in synchronization with a cassette attaching operation when the thread cassette 10 is attached to the cassette mount 5, a needle bar vertically moving mechanism 18 moving the needle bar 12 vertically, a needle bar rocking mechanism 19 rocking the needle bar 12, a needle thread take-up driving mechanism, etc.

The needle bar 12 is mounted on a needle bar holder 80 (see FIG. 15) for vertical movement. The needle bar holder 80 is further mounted on a sewing machine frame (not shown) of the sewing machine M so as to be rocked in the right-and-left direction. The sewing machine M is provided with a sewing machine motor 9 (see FIG. 17) which is driven to rotate a spindle (not shown) so that the needle bar vertical moving mechanism 18 is driven to move the needle bar 12 up and down. A manual pulley 33 is provided on a right end of the arm 3 (upper end of the pillar 2) for manually rotating the spindle.

The thread feeding mechanism 16A is provided for guiding the thread 11 drawn from the thread cassette 10 near a hole 12*b* (see FIG. 16) of the needle 12*a* mounted on the needle bar 12. The threading mechanism 16*b* passes the thread 11 guided by the thread feeding mechanism 16A through the needle hole 12*b*. The thread guiding mechanism 17 guides the thread 11 drawn from the thread cassette 10 so as to be caught by the needle bar thread guide 12*d* (see FIG. 14).

Figure 3:
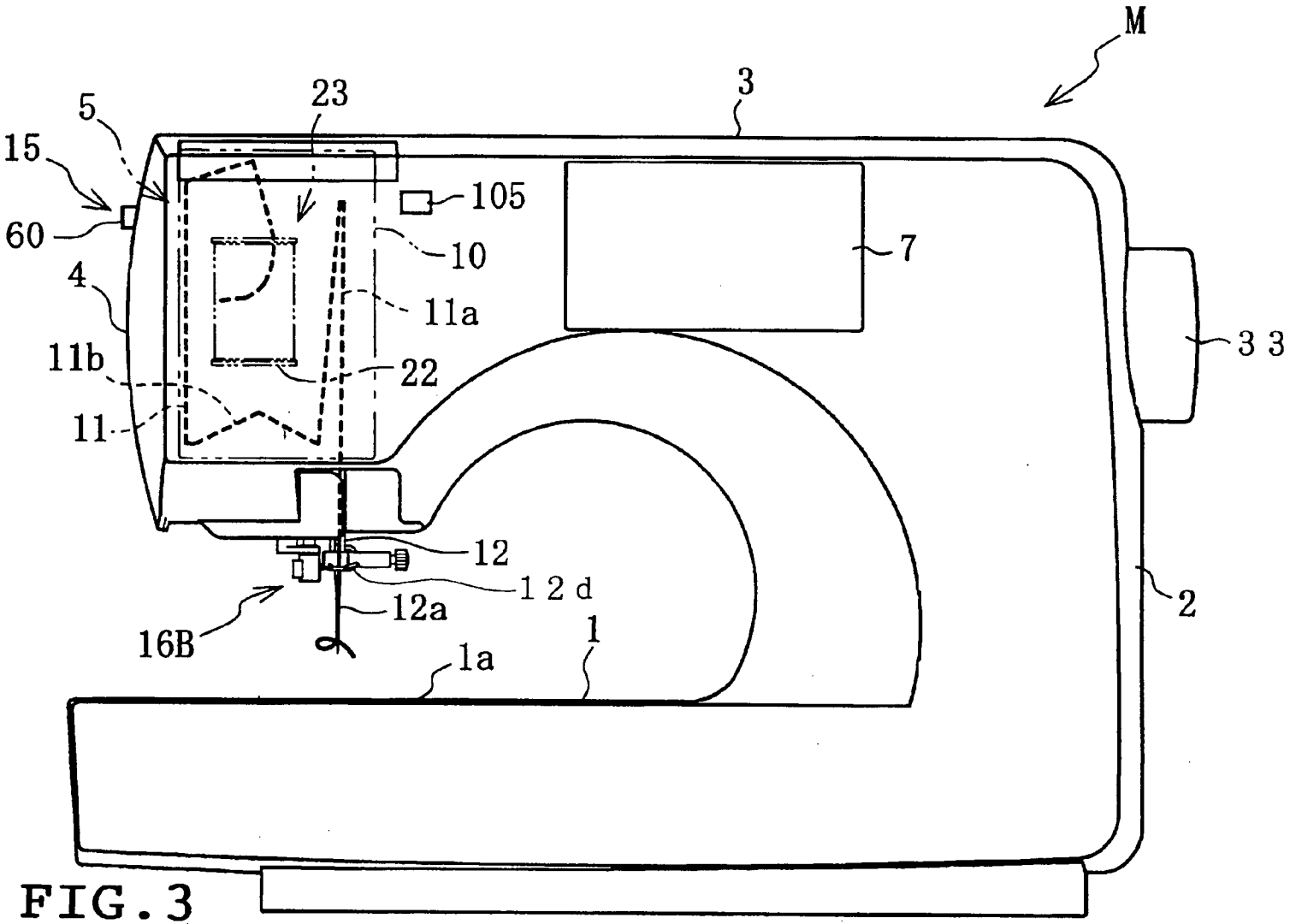
FIG. 3 is a front view of the sewing machine in a condition where the thread cassette has been attached to the cassette mount.
Figure 4:
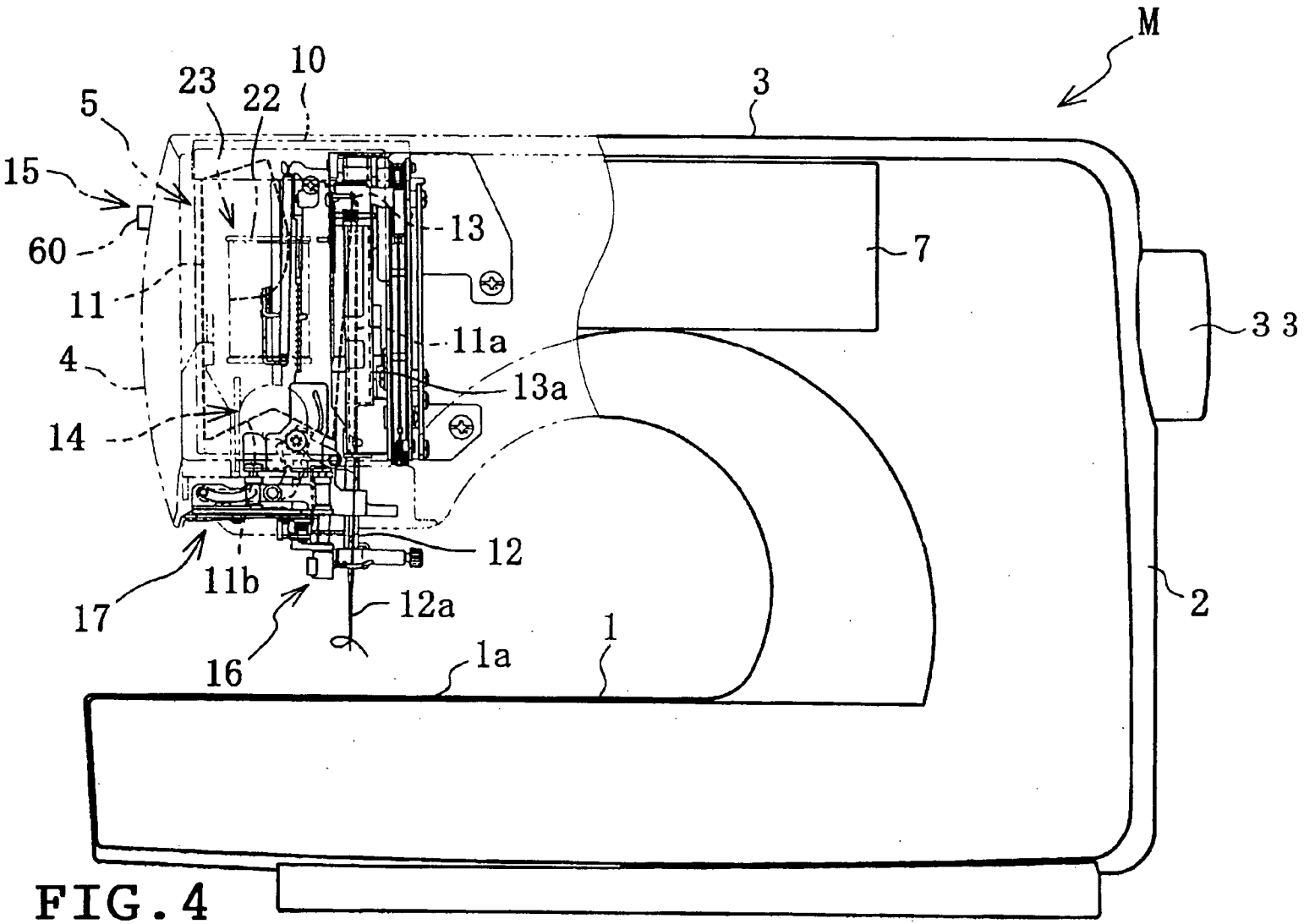
FIG. 4 is a front view of the sewing machine, showing the inner arrangement of the sewing head in a condition where the thread cassette has been attached to the cassette mount.
Figure 5:
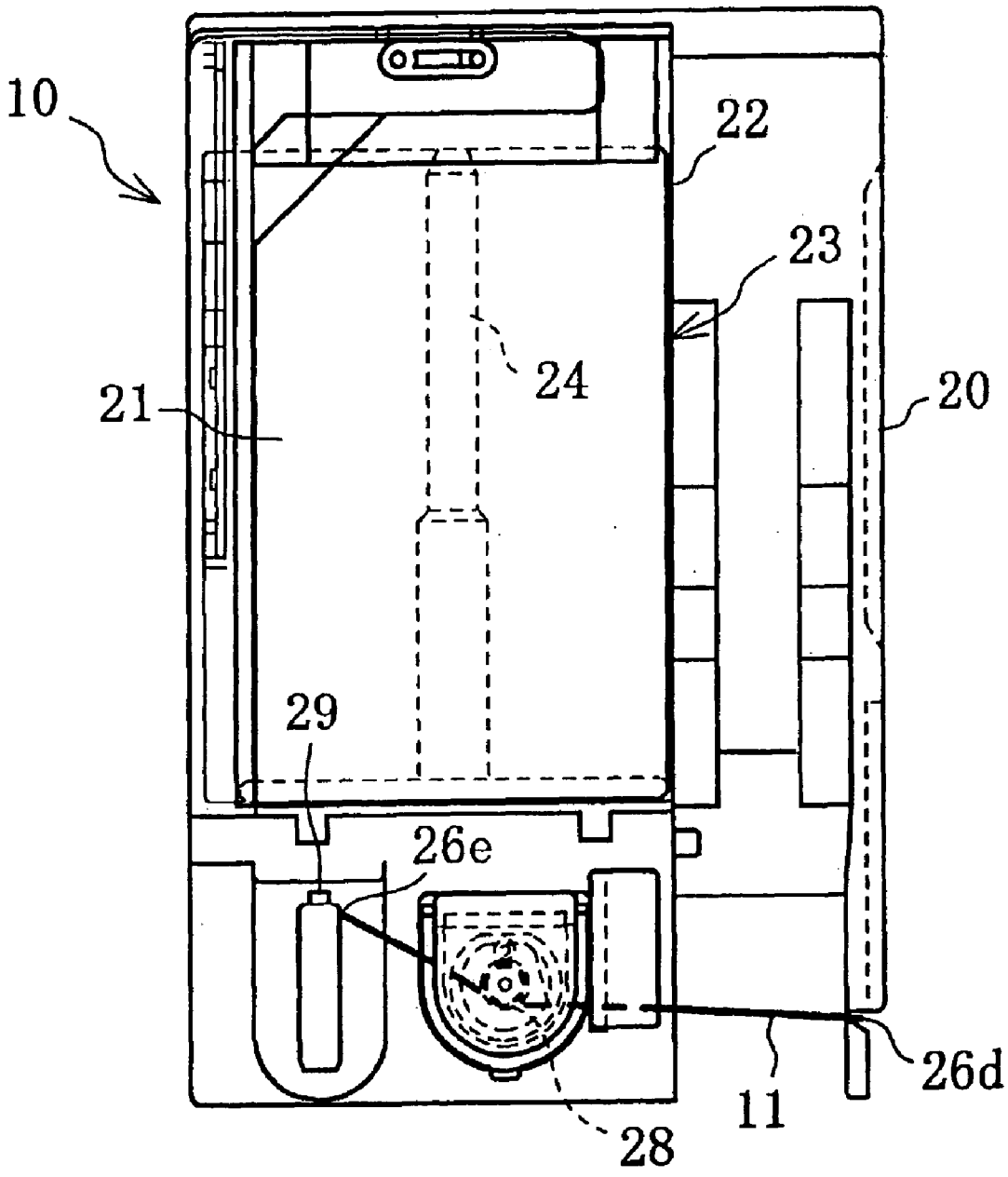
FIG. 5 is a front view of the thread cassette.
Figure 6:
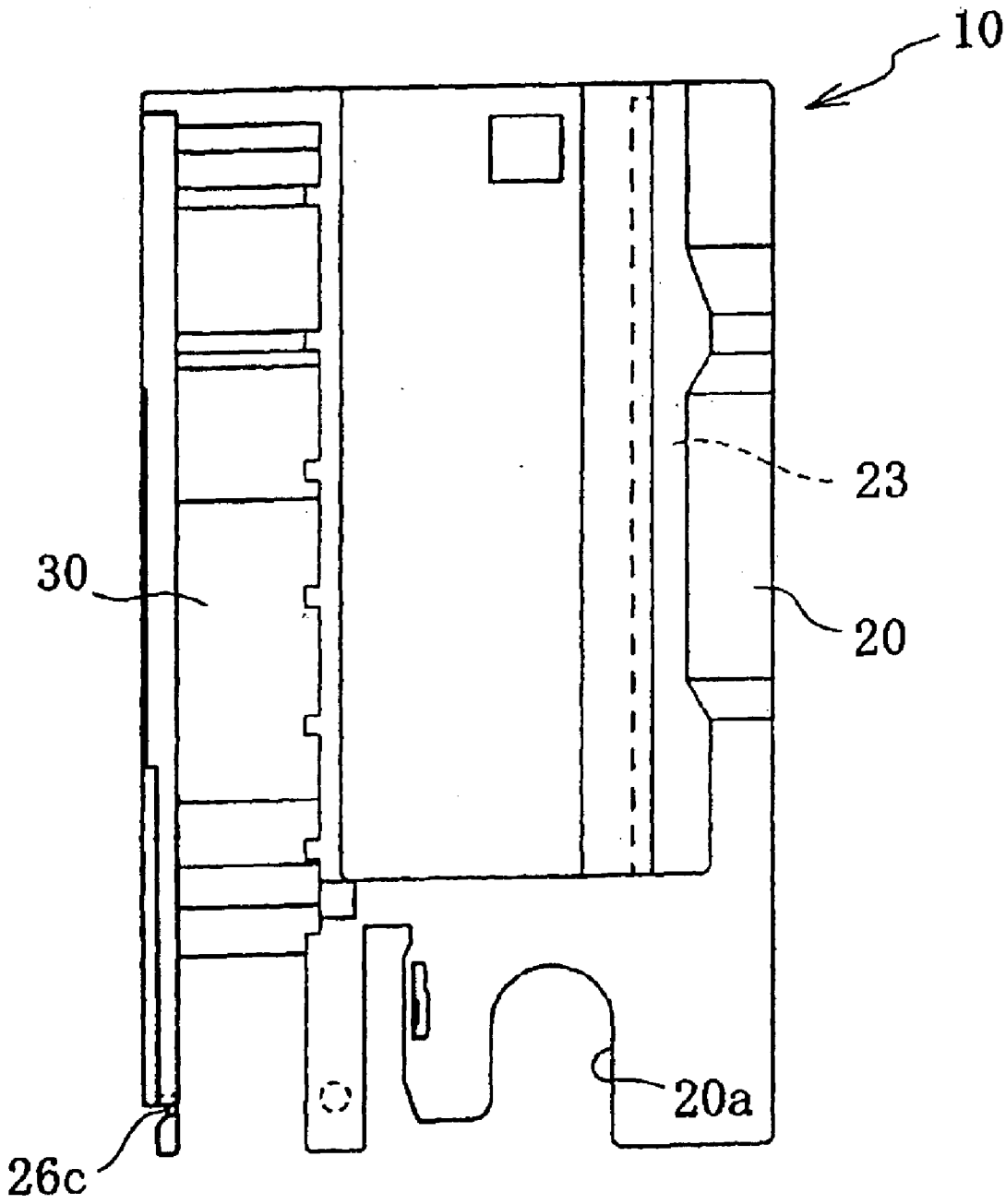
FIG. 6 is a rear view of the thread cassette.
Figure 7:
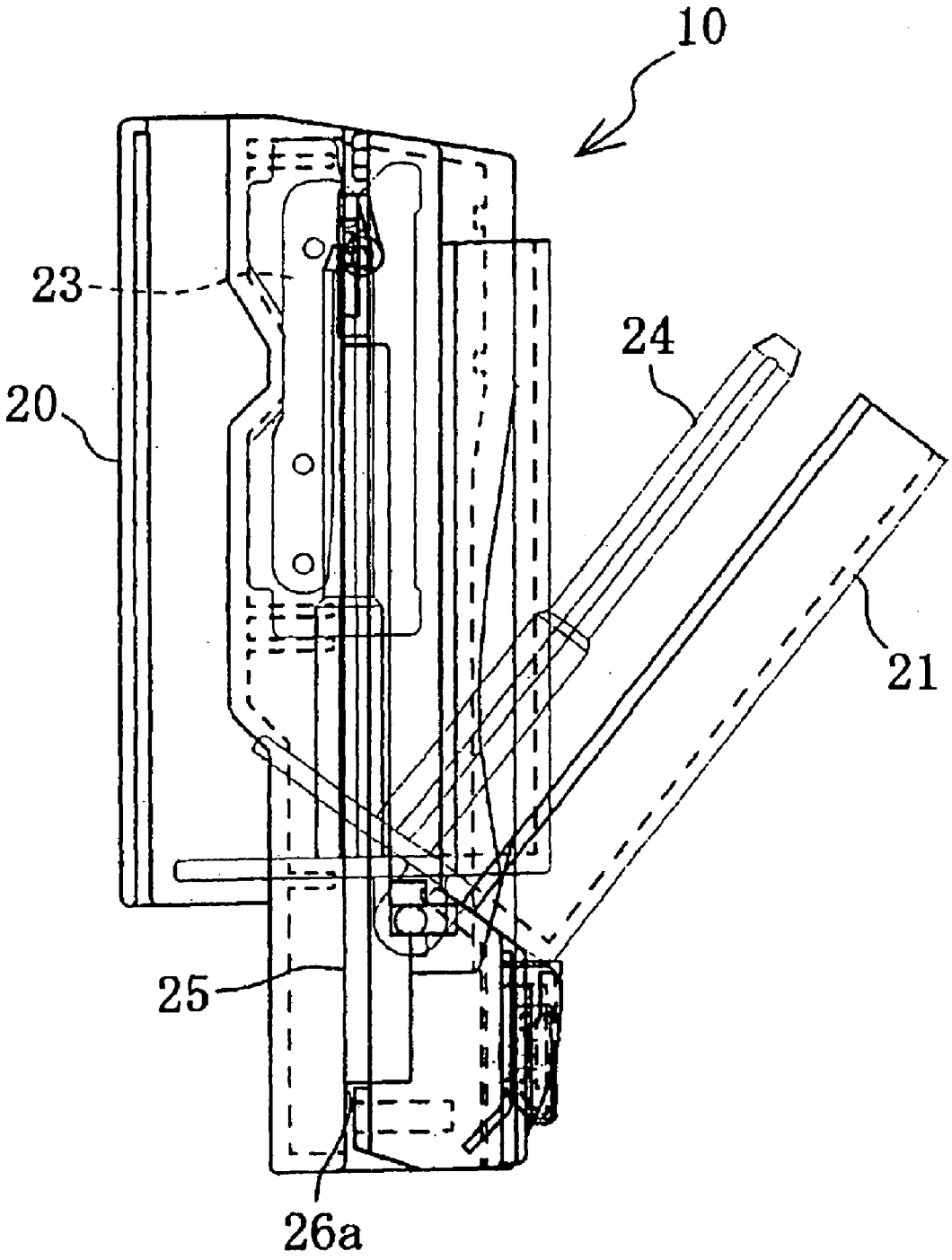
FIG. 7 is a left side view of the thread cassette with a closing member being opened.
Figure 8:
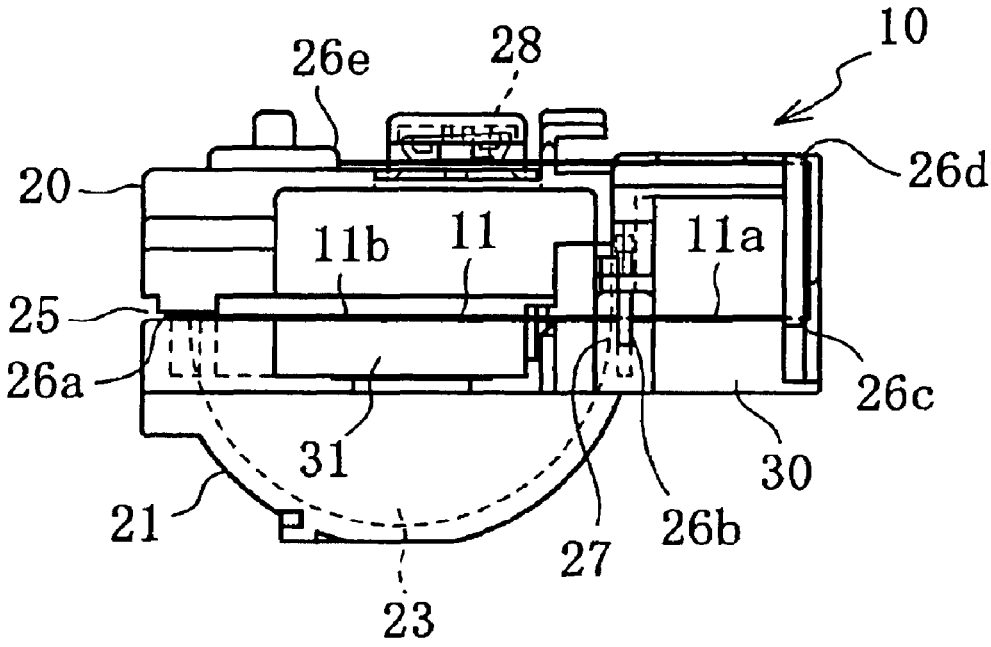
FIG. 8 is a bottom view of the thread cassette.

Referring to FIGS. 3 and 4, the thread 11 drawn from the thread cassette 10 attached to the cassette mount 5 is caught on a thread tensioning shaft 40 (see FIG. 11) between the paired thread tension discs 41 and 42 of the thread tensioning mechanism 14 from above. The thread 11 extending downstream is caught on the needle thread take-up 13. Furthermore, the thread 11 is caused to pass through the needle hole 12*b* of the needle 12*a*, whereby the sewing machine is set so as to perform the sewing.

On the other hand, a bobbin mount (not shown) is provided on the bed 1. A thread extending from a bobbin (not shown) serves as a bobbin thread. Furthermore, a shuttle mechanism (not shown) is provided in the bed 1. When the needle and bobbin threads are set and the motor 9 is driven, the shuttle mechanism is driven in synchronization with the vertical movement of the needle bar 12. The needle thread 11 is caught near the needle 12*a* moved downward lower than the needle plate la of the bed 1 by the shuttle mechanism, so that the needle and bobbin threads are entangled into stitches.

The thread cassette 10 will now be described. Referring to FIGS. 5 to 8, the thread cassette 10 includes a cassette body 20 and a closing member 21 pivotally mounted on the cassette body 20 so as to open and close a front opening of the body. A thread accommodating section 23 is defined in the cassette body 20 to accommodate a thread spool 22 serving as a thread supply. A spool pin 24 is mounted on the closing member 21. The spool pin 24 can be attached to and detached from the thread spool 22 when the closing member 21 is opened frontward (see FIG. 7). The thread spool 22 is accommodated in the accommodating section 23 when the closing member 21 is closed with the thread spool 22 being inserted onto the spool pin 24.

The thread 11 drawn from the thread spool 22 is guided upward outside the accommodating section 23. Passing along a thread passage 25 between the cassette body 20 and the left end of the closing member 21, the thread 11 is guided to a thread guide 26*a* of the left lower end of the thread cassette 10 to be caught on the thread guide. The thread 11 is further guided rightward to be caught on a thread guide 26*b* of the lower end of a partition wall 27 and a thread guide 26*c* of the right lower end of the thread cassette 10 in turn. The thread 11 is further guided forward to be caught on a thread guide 26*d* and then returned. The thread 11 is further guided leftward to be held by a thread holder 28. The thread 11 further extending leftward from the thread holder 28 is cut by a left-hand blade 29 of the thread holder and then caught on a thread guide 26*e*, thereby being set.

The thread cassette 10 from which the thread 11 is drawn to be set as described above is not attached to the cassette mount 5 but is ready for attachment. The thread cassette 10 has a needle thread take-up guide space 30 defined in a right end thereof. The guide space 30 is open at the rear and lower portion of the thread cassette 10. The guide space 30 extends substantially over the entire vertical length. The thread cassette 10 has a thread tensioning space 31 formed in a central lower portion thereof. The thread tensioning space 31 is open downward. The spaces 30 and 31 are partitioned by a partition wall 27.

When attached to the cassette mount 5, the thread cassette 10 is inserted into the cassette mount 5 from above. In this case, the needle thread take-up 13 and a needle thread take-up guide 13*a* (see FIG. 2) guiding the take-up enter the guide space 30 from below, and the thread tensioning shaft 40 of the thread tensioning mechanism 14 and the thread tension discs 41 and 42 enter the thread tensioning space 31. The cassette body 20 has a notch 2o*a* formed in a lower end of a rear wall thereof in order that an interference may be prevented between the thread tensioning shaft 40 and the thread cassette 10.

Figure 2:
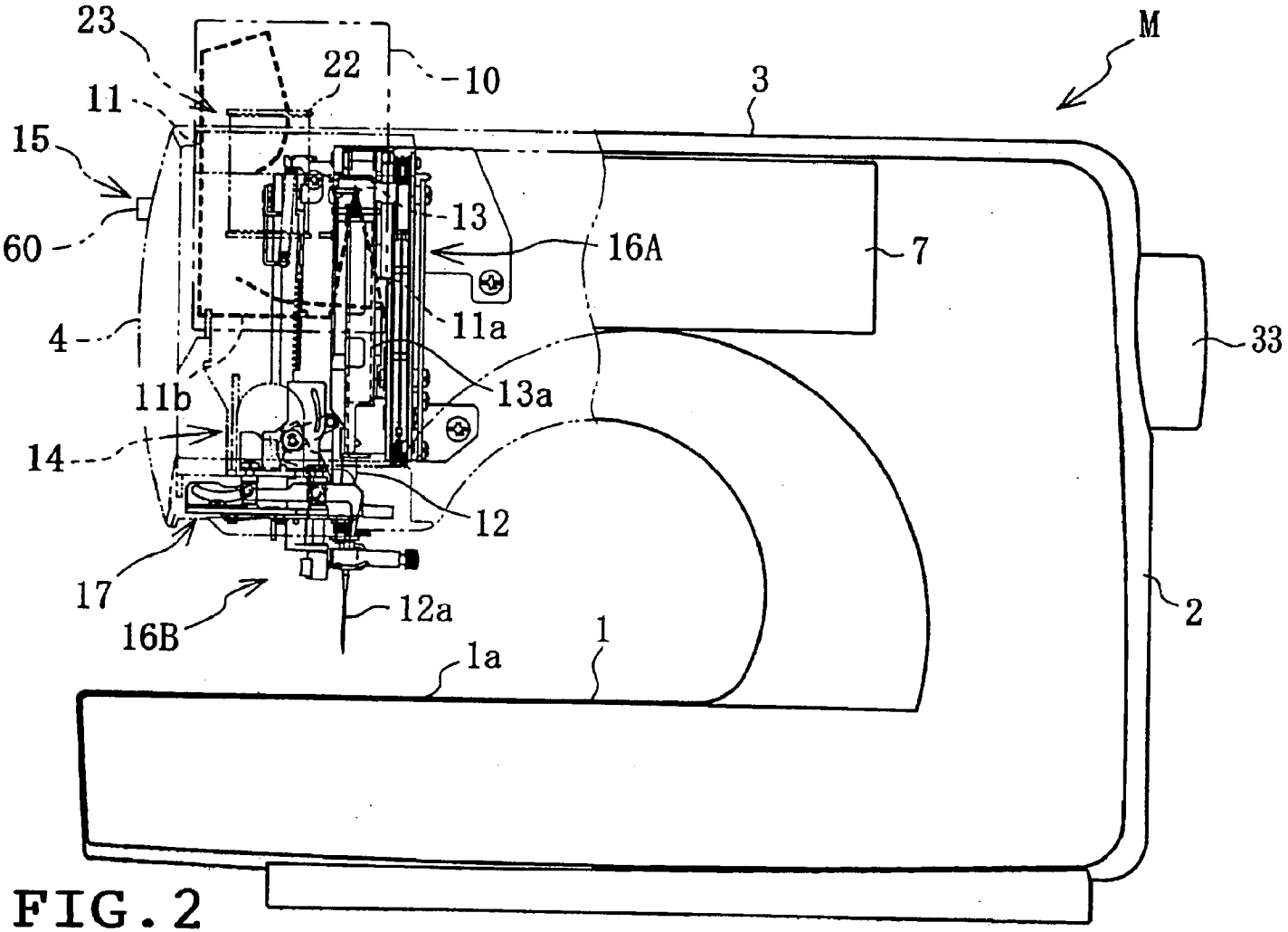
FIG. 2 is a front view of the sewing machine, showing an inner arrangement of the sewing head in a condition where the thread cassette is being attached to the cassette mount.

When the thread cassette 10 is inserted slightly into the cassette mount 5, a thread part 11*a* between the thread guides 26*b* and 26*c* is caught on the needle thread take-up 13 having entered the guide space 30. Thereafter, when the thread cassette 10 is further inserted into the cassette mount 5, the thread guides 26*a* and 26*b* are lowered relative to the needle thread take-up 13 on which the thread part 11*a* has been caught. However, since the thread 11 located downstream with respect to the thread part 11*a* is held by the thread holder 28, the thread 11 is drawn from the thread spool 22 in the thread accommodating section 23. For example, FIGS. 1 and 2 show a triangular thread part 11*a* when two thirds of the thread cassette 10 are inserted into the cassette mount 5.

When the thread cassette 10 has been attached to the cassette mount 5, a thread part 11*b* between the thread guides 26*a* and 26*b* is caught by the thread tensioning shaft 40 between the thread tension discs 41 and 42 having entered the thread tensioning space 31, as shown in FIGS. 3 and 4.

The thread tensioning mechanism 14 will now be described. Referring to FIGS. 9 to 13, the thread tensioning mechanism 14 includes the thread tensioning shaft 40 fixed to the frame 40*a* (see FIG. 12B) and extending rearward, the front thread tension disc 41 fixedly fitted with the thread tensioning shaft, the rear thread tension disc 42 fitted with the thread tensioning shaft so as to be brought into a face-to-face contact with the front thread tension disc, a thread tensioning spring 42*a* comprising a compression coil spring provided on the thread tensioning shaft 40 for urging the disc 42 against the forward disc 41, and a switching mechanism 43 including a pulse motor 44 opening and closing the discs 41 and 42.

Referring to FIGS. 12 and 13, the switching mechanism 43 includes a pulse motor 44, driving gear 45, cam member 46, link members 47 and 48, rotational link member 49 and extension coil spring 50, pushing link member 51 and opening lever member 52. The driving gear 45 secured to an output shaft of the pulse motor 44 is in mesh engagement with a gear 46*a* of the cam member 46. The link member 47 is pivotally mounted at its central portion on a support shaft 47*a* and an upper end at which a cam follower 47*b* engaging a cam groove 46*b* of the cam member 46, whereas a pin 47*c* at the lower end is in engagement with a central elongated hole 48*a* of the link 48. The link 48 is supported so as to be moved in the right-and-left direction.

The rotational link member 49 is pivotally mounted at its central portion on a support shaft 49. The rotational link member 49 is urged counterclockwise by the extension coil spring 50. The rotational link member 49 has a rear end formed with an engaging portion 49*b* which is in engagement with an elongated hole 48*b* formed in the left end of the link member 48. The rotational link member 49 has a right end formed with a pin 49*c* which is in engagement with a central elongated hole 51*b* of a pressing member 51. The pressing member 51 has a right end pivotally mounted on a support shaft 51*a*. An opening lever member 52 is fixed to the rear thread tension disc 42.

Referring to FIG. 12, the paired thread tension discs 41 and 42 are closed when a cam follower 47*b* is in engagement with a cam groove 46*b*1 with the same diameter as the cam groove 46*b*. The cam groove 46*b*1 extends over about 80 degrees and can drive the pulse motor 44 in an angular range corresponding to the aforesaid angle of about 80 degrees while the cam follower 47*b* remains engaged with the cam groove 46*b*1. The reason for this is that the pulse motor 44 and driving gear 45 of the switching mechanism 43 also constitute a part of the needle bar rocking mechanism 19, whereupon the needle bar 12 can be rocked while the thread tension discs 41 and 42 are closed. The needle bar rocking mechanism 19 includes the pulse motor 44, driving gear 45, a gear 19*a* brought into mesh engagement with the driving gear 45 and a cam 19*b* fixedly provided on the gear 19*a* and produces a rocking motion of the needle bar 12 by a rotating cam 19*b*.

Figures 13A, 13B:
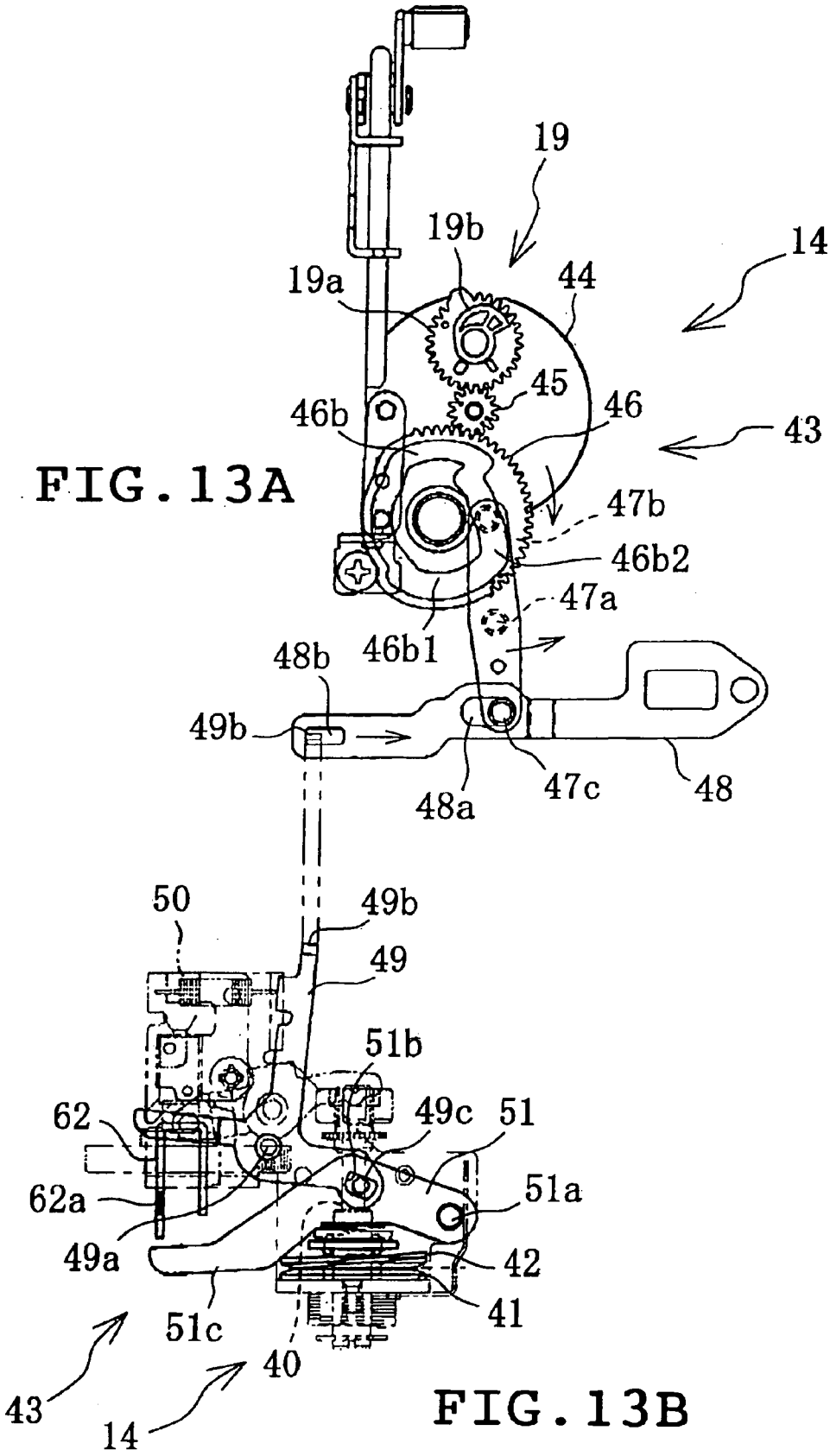
FIGS. 13A and 13B are front and plan views of the thread tensioning mechanism in an open state respectively.

On the other hand, upon drive of the pulse motor 44, the cam member 46 is rotated clockwise as shown by arrow in FIG. 13A so that the cam follower 47*b* engages the cam groove part 46*b*2 of the cam groove 46b, moving to the central side of the cam member 46. Then, the link members 47 and 48 and the rotational link member 49 are synchronously moved in the directions of arrows, so that the opening lever member 52 is pressed forward by the left lever 51*c* by the pressing member 51 moving forward. As a result, the rear disc 42 is moved so as to be inclined such that a space is defined between the discs, whereby the discs are opened.

When the thread cassette 10 is attached to the cassette mount 5 while the thread tension discs 41 and 42 are open, the thread part 11*b* of the thread 11 drawn from the thread cassette 10 is caught on the thread tensioning shaft 40 between the discs 41 and 42. Successively, when the pulse motor 44 is driven so that the cam member 46 is rotated counterclockwise or in the direction opposite the arrow, the urging force of the extension coil spring 50 returns the rotational link member 49 to the former position, so that the discs 41 and 42 are closed by the thread tensioning spring 42*a*. The needle bar 12 is moved to the position as shown by the chain line in FIG. 9 while the paired thread tension discs 41 and 42 are open.

Accordingly, the pulse motor 44 serves as a driving mechanism section for driving in common the needle bar rocking mechanism 19 and the threading mechanism 14. Furthermore, the pulse motor 44 is provided with an encoder (not shown) detecting an origin and an angle of rotation (amount of drive). A zigzag position of the needle bar 12 and the open or closed state of the thread tensioning mechanism (paired thread tension discs 41 and 42) are detected on the basis of the rotation angle of the pulse motor 44 (amount of drive) detected by the encoder.

Figure 9:
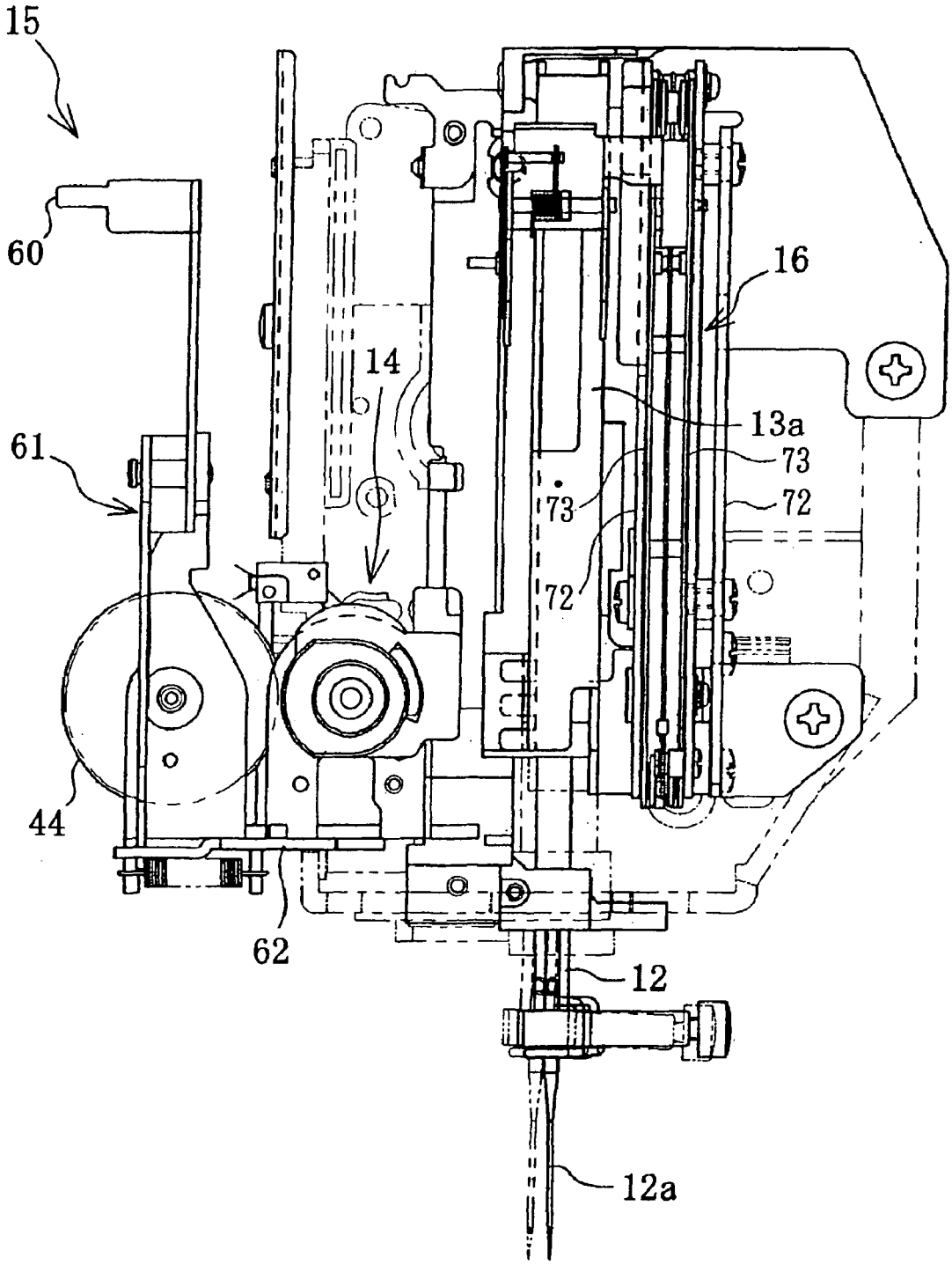
FIG. 9 is an enlarged front view of a thread feeding mechanism and a thread tensioning mechanism in the head of the sewing machine.
Figure 10:
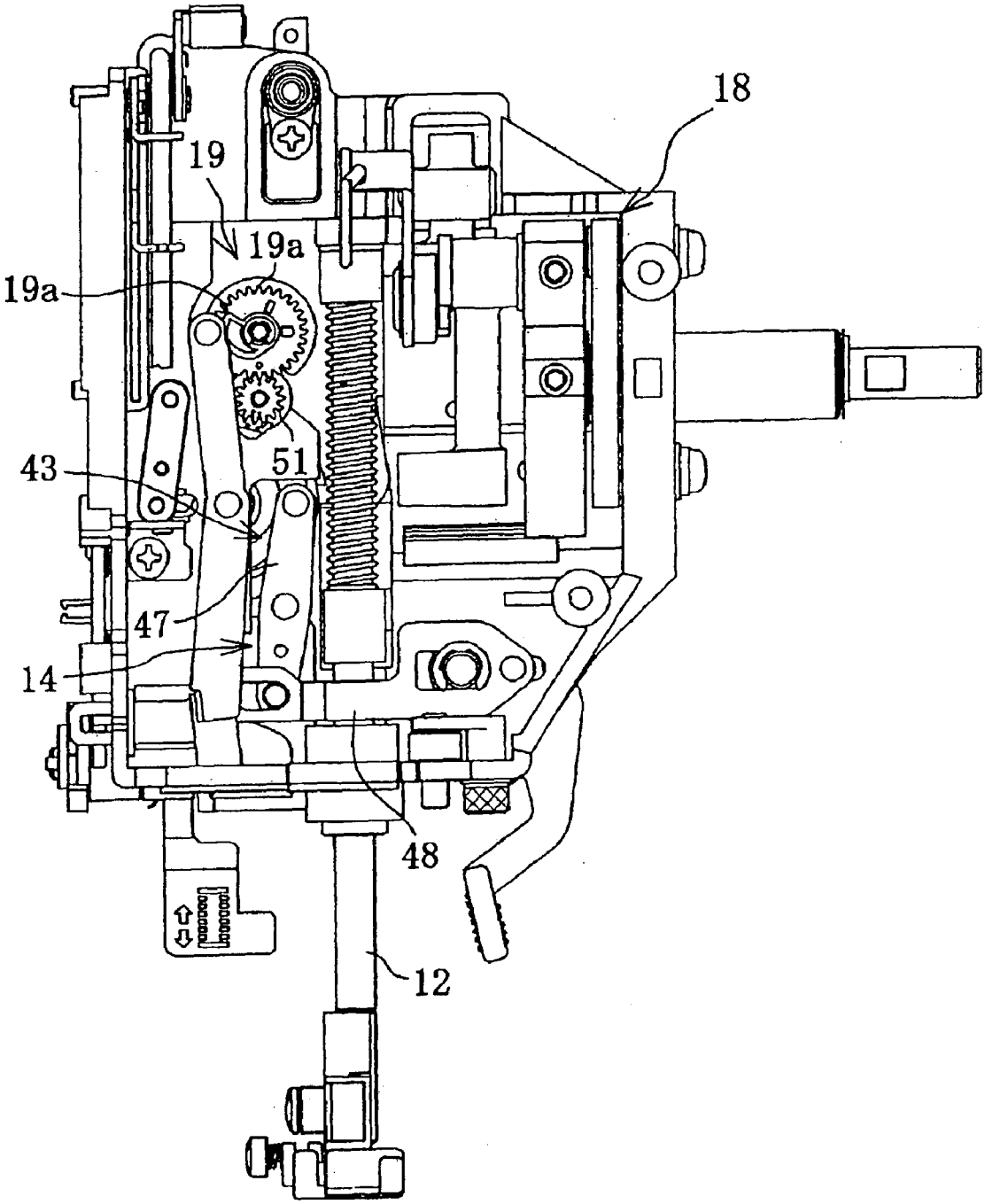
FIG. 10 is an enlarged front view of a thread feeding mechanism and a thread tensioning mechanism in the head of the sewing machine.
Figure 11:
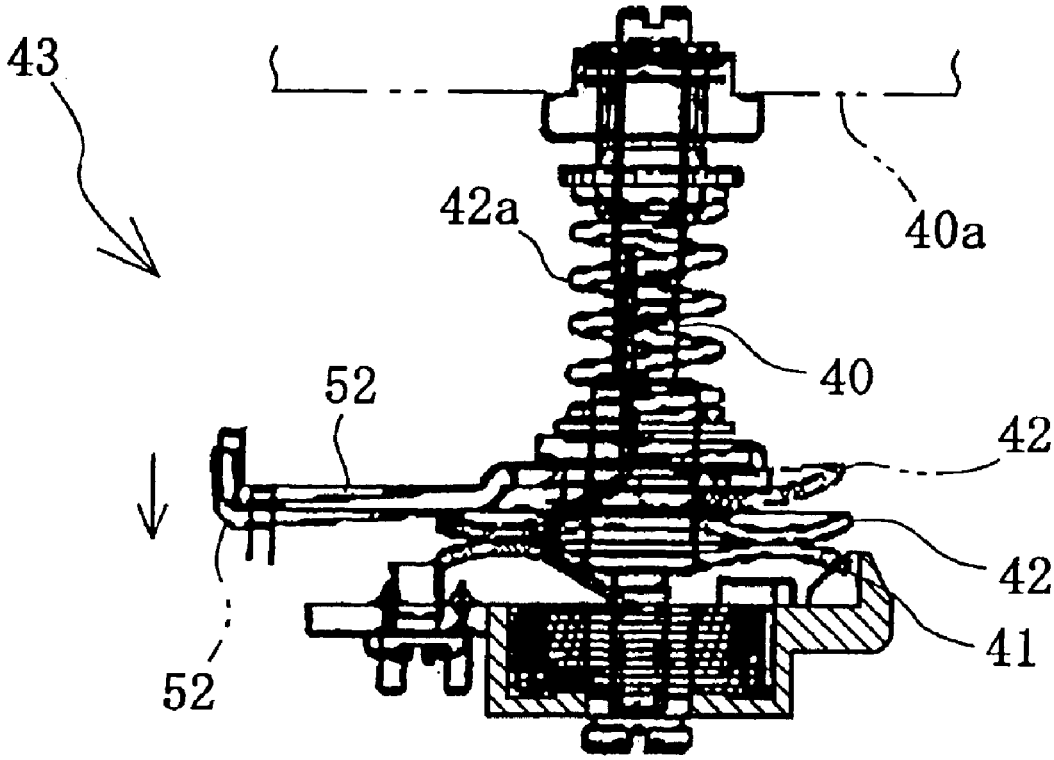
FIG. 11 is a plan view of thread tension discs of the thread tensioning mechanism.
Figures 12A, 12B:
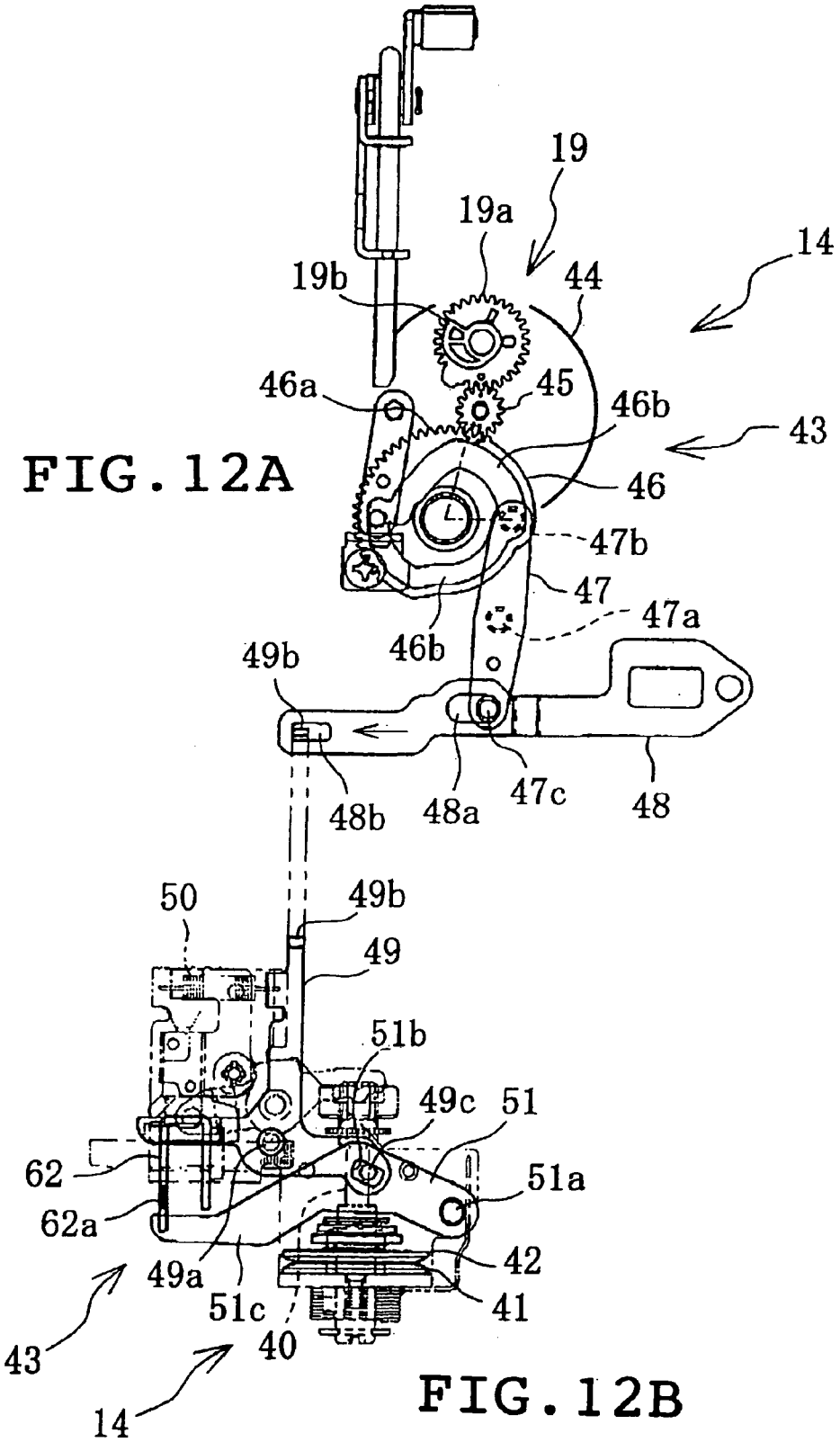
FIGS. 12A and 12B are front and plan views of the thread tensioning mechanism in a closed state respectively.

The thread tension releasing mechanism 15 will now be described. Referring to FIGS. 9, 12B and 13B, the thread tension releasing mechanism 15 includes a release operation member 60 operated to detach the thread cassette 10 from the cassette mount 5, an operating force transmitting mechanism 61 including a link mechanism transmitting an operating force of the release operation member 60, and a thread opening member 62 moved forward by the operating force transmitted via the operating force transmitting mechanism 61. In this construction, upon operation of the release operation member 60, the thread opening member 62 is moved forward so that the lever 51*c* of the pressing member 51 pushed forward by the pressing portion 62*a* of the thread opening member 62. As a result, the paired thread tension discs 41 and 42 are opened in the same manner as described above. In this case, the rotational link member 49 is rotated clockwise so that the engagement portion 49*b* is moved rightward. Since the engagement portion 49*b* is in engagement with the elongated hole 48*b* so as to be moved rightward, the link member 48 is not moved.

Figure 14:
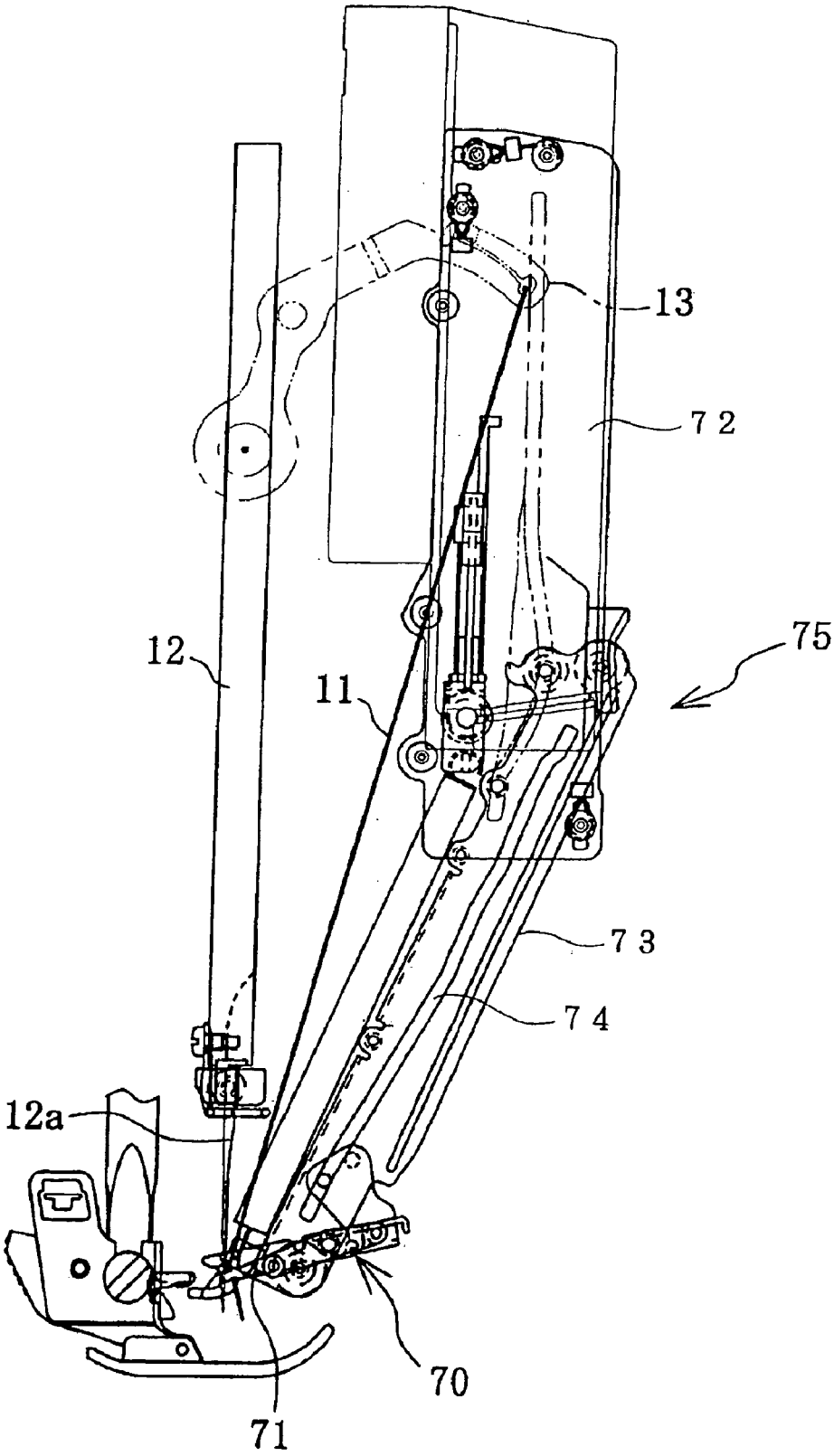
FIG. 14 is a left side view of the thread feeding mechanism.

The thread feeding mechanism 16A will be described. Referring to FIGS. 9 and 14, the thread feeding mechanism 16A includes a thread guide member 70 catching the thread 11 drawn from the thread cassette 10 and a thread guide driving mechanism 75 lowering the guide member 70 from an upper stand-by position (see FIG. 9) via a catching position (not shown) to a thread feed position (see FIG. 14) while the attitude of the guide member is being changed.

The thread guide driving mechanism 75 includes a fixed support plate 72 mounted to the sewing machine frame, a moving support plate 73 moved vertically relative to the fixed support plate 72, and a running block mechanism operated in synchronization with insertion of the thread cassette 10 into the cassette mount 5. The moving support plate 73 has a side face formed with a guide groove 74 guiding the guide member 70 and extending substantially in the vertical direction. When the thread cassette 10 is attached to the cassette mount 5, the moving support plate 73 is lowered relative to the fixed support plate 72 and the guide member 70 is lowered relative to the moving support plate 73 thereby to be moved to the thread feed position.

The guide member 70 has a pair of thread guide plates 71, which catch a part of the thread 11 downstream relative to the needle thread take-up 13, at a guide position. The thread 11 is horizontally stretched while extending between the thread guide plates 71. When the guide member 70 is located at the thread feed position, the thread 11 extending between the thread guide plates 71 is located in front of the needle 12*a* near the needle hole 12*b*, as shown in FIG. 14.

Figure 15A:
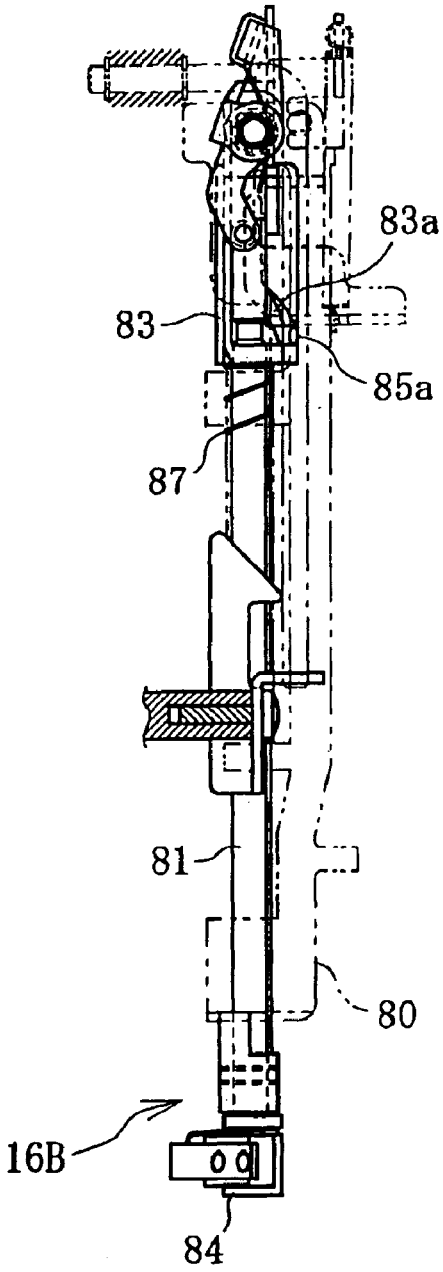
FIGS. 15A and 15B are left side and front views of the threading mechanism.
Figure 15B:
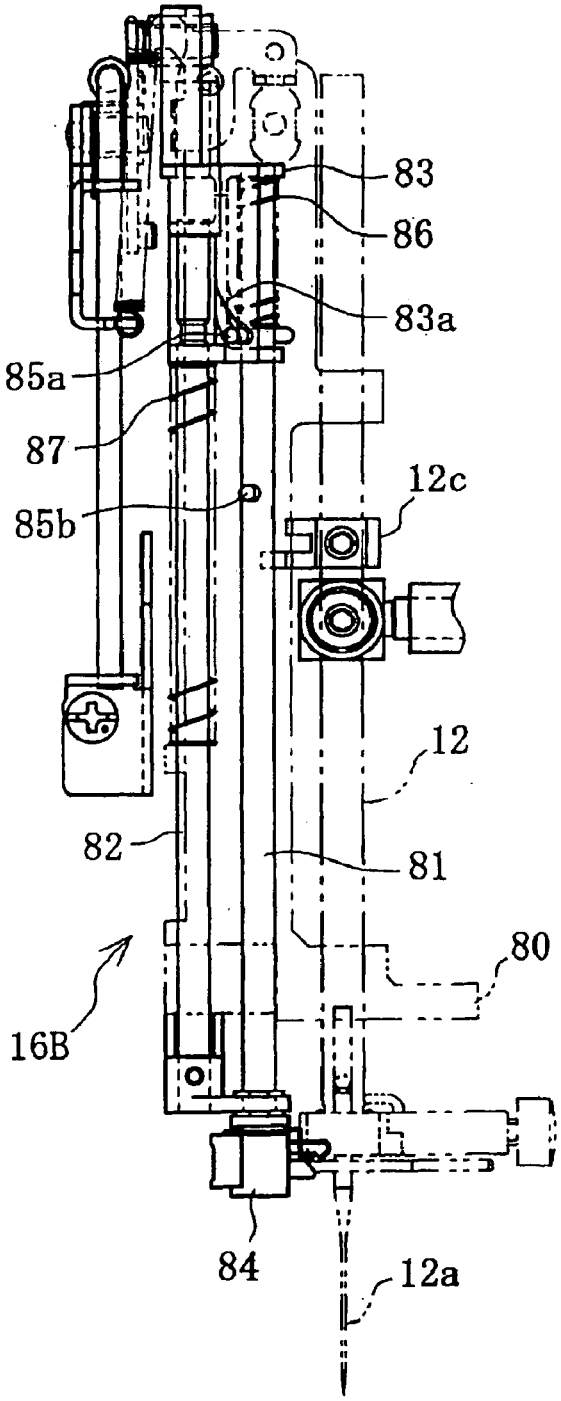

The threading mechanism 16B will be described. Referring to FIGS. 15 and 16, the threading mechanism 16B is provided on the needle bar frame 80 supporting the needle bar 12 and includes a threading shaft 81 and a slider guide shaft 82 both mounted on the needle bar frame 80 on the left of the needle bar 12 so as to be moved up and down, a threading slider 83 fitted with upper ends of the shafts 81 and 82 so as to be moved vertically, and a hook mechanism section 84 mounted on the lower end of the threading shaft 81. The needle bar 12 and the threading mechanism 16B are moved integrally.

Two upper and lower pins 85*a* and 85*b* protrude from an upper portion of the threading shaft 81. The upper pin 85*a* is engaged with a spiral engagement groove 83*a* formed in the threading slider 83. The lower pin 85*b* is capable of engagement with an engagement member 12*c* secured to the needle bar 12 from above. A compression coil spring 86 is provided around the threading shaft 81 to urge the slider 83 upward relative to the threading shaft. The pin 85*a* is usually in engagement with the lower end of the engagement groove 83*a*. Furthermore, a compression coil spring 87 is provided around the slider guide shaft 82 to urge the slider 83 upward. The threading shaft 81 and the slider 83 are usually located at respective uppermost positions.

Referring to FIG. 16, the hook mechanism section 84 includes a threading hook 88 capable of being passed through the needle hole 12*b* and having a thread catching portion 88*a* at its distal end, two guide members 89 located at both sides of the threading hook 88, and a wire 90 capable of engaging the thread catching portion 88*a* of the threading hook 88. The threading mechanism 16B is usually in the normal state as shown in FIG. 15 when the thread cassette 10 is not attached to the cassette mount 5 and the thread cassette 10 is attached to the cassette mount 5. On the other hand, when the thread cassette 10 is inserted into the cassette mount 5, the threading slider 83 is lowered. The threading shaft 81 is also lowered together with the threading slider 83 at an initial stage. When the pin 85*b* of the threading shaft 81 engages the engagement member 12*c* of the needle bar 12 from above, the lower movement of the threading shaft 81 is prohibited, whereupon the threading shaft is stopped. As a result, the threading shaft 81 is positioned relative to the needle bar 12 with respect to its vertical position.

Figure 16A:
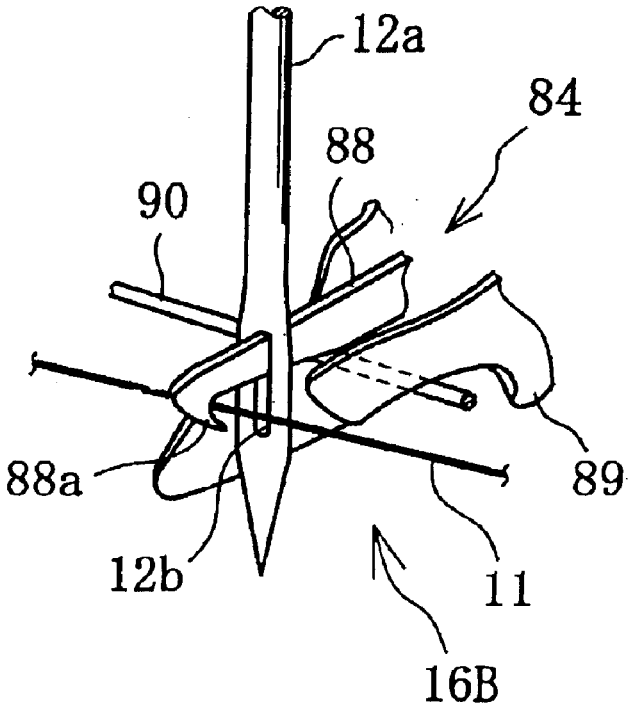
FIGS. 16A and 16B are enlarged perspective views of a threading hook of the threading mechanism in a condition where the hook has been passed through the needle hole and in a condition where the hook has been pulled out through the needle hole such that the thread extends through the needle hole.
Figure 16B:
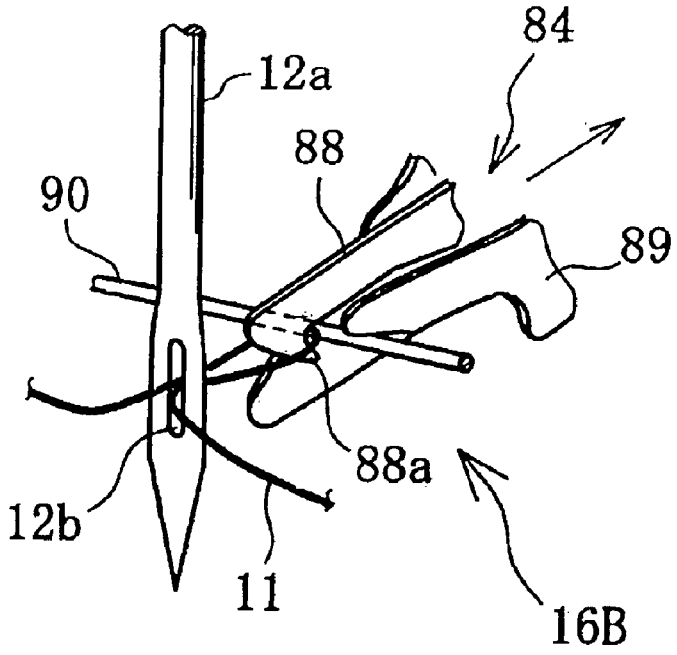

Thereafter, when the threading slider 83 is further lowered relative to the threading slider 81, the pin 85*a* moves upward along the spiral engagement groove 83*a* of the threading slider 83 while engaging the groove, whereupon the threading shaft 81 is rotated. The hook mechanism 84 is located near the needle 12*a* and moreover, the thread 11 drawn from the thread cassette 10 is also carried near the needle 12*a* to be held in front of the needle in the stretched state. More specifically, upon rotation of the threading shaft 81, the hook 88 of the hook mechanism section 84 is passed through the needle hole 12*b* as shown in FIG. 16A and the thread 11 is caught on the distal end thread catching portion 88*a* as shown in FIG. 16B. Successively, the threading shaft 81 is rotated in the opposite direction so that the threading hook 88 is returned through the needle hole 12*b*, whereby the thread 11 extends through the needle hole. The thread 11 is also caught on the needle bar guide 12*d* by the thread guiding mechanism 17. Upon completion of the threading operation, the threading mechanism 16B is returned to the normal state as shown in FIG. 15 by a spring force or the like. Furthermore, the guide member 70 of the thread feeding mechanism 16A is returned to the stand-by position.

The needle bar 12 and the threading mechanism 16B are rocked integrally relative to the sewing machine frame, whereas the thread feeding mechanism 16A is fixedly provided relative to the sewing machine frame. This changes the relation between the position of the needle hole 12*b* and the position of the thread 11 having been carried by the thread feeding mechanism 16A depending upon a zigzag position of the needle bar 12. Accordingly, there is a possibility that the threading hook 88 cannot catch the thread 11 fed by the thread feeding mechanism 16A. Furthermore, regarding the vertical position of the needle bar 12, too, if the level of the needle hole 12*b* does not have a proper positional relation with the position of the thread 11 having been carried by the thread feeding mechanism 16A, there is a possibility that the threading operation cannot desirably be carried out by the threading mechanism 16B.

In the sewing machine M, the needle bar 12 is located at a predetermined position near a needle top position and at a predetermined zigzag position as shown by chain line in FIG. 9. In this state, when the thread feeding mechanism 16A and threading mechanism 16B are operated, the sewing machine is set so that the thread 11 can reliably be passed through the needle hole 12*b*. More specifically, the left needle position as shown in FIG. 9 is set relative to the position of the thread feeding mechanism 16A. Furthermore, the predetermined position near the needle top position is previously set in a range from 20 to 50 degrees as a threadable rotational angle range of the spindle.

A spindle rotation angle detecting sensor 101 (see FIG. 17) is provided on the spindle for detecting a rotation angle of the spindle. The spindle rotation angle detecting sensor 101 comprises an encoder, for example, and detects a rotation angle of the spindle. In this case, a rotation angle corresponding to the uppermost position of the needle bar 12 (needle 12*a*) is set at 0 degrees (360 degrees). A vertical position of the needle bar can be detected from a rotation angle of the spindle detected by the spindle rotation angle detecting sensor 101.

A bobbin thread winding mechanism is provided on the right of the arm 3 although the mechanism is not shown. The bobbin thread winding mechanism switches a bobbin thread winding shaft to which the bobbin is detachably attached, between a stand-by position and a winding position. Furthermore, a cassette mount is provided near the bobbin thread winding shaft. A supply of thread such as the thread spool 13 accommodated in the thread cassette 10 or the individual thread spool is detachably attached to the cassette mount. The bobbin thread winding shaft is switched to the winding position and then, a driving force of the sewing machine motor 9 is transmitted to the bobbin thread winding shaft. Thus, the bobbin thread winding shaft is rotated but no driving force is transmitted to the needle bar vertically moving mechanism 18. The bobbin thread winding shaft is usually located at the stand-by position so that the driving force of the motor 9 is transmitted to the needle bar vertically moving mechanism 18.

Thus, the user switches the bobbin thread winding shaft to the winding position and attaches the bobbin to the bobbin thread winding shaft. The user further sets the thread supply to the cassette mount, drawing out the thread from the thread supply. The distal end of the thread drawn is wound on the bobbin. When the start button is turned on, the bobbin is rotated together with the bobbin thread winding shaft so that the thread of the thread supply is wound on the bobbin. The bobbin thread winding mechanism is provided with a winding switch detecting switch 106 (see FIG. 17) for detecting a position of the bobbin thread winding shaft (the stand-by position or winding position). The switch 106 serves as a thread winding detecting unit.

A cassette detecting switch 102 (see FIG. 17) is provided near the lower end of cassette mount 5 for detecting ejection of the thread cassette 10 from the cassette mount 5. The cassette detecting switch 102 comprises a limit switch, for example. The switch 102 is turned on when the thread cassette 10 has been attached to the cassette mount 5. The switch 102 is turned off when the thread cassette 10 has been ejected from the cassette mount 5. Accordingly, attachment of the thread cassette 10 to the cassette mount 5 can be detected by the cassette detecting switch 102.

Referring to FIGS. 1 and 3, LED 105 is provided near the cassette mount 5 of the head 4. LED 105 serves as a informing unit for informing the user whether the thread cassette 10 can be attached to the cassette mount 5. LED 105 is turned on when the thread cassette 10 can or may be attached to the cassette mount 5, whereas it is turned off when the thread cassette cannot or should not be attached to the cassette mount.

Figure 17:
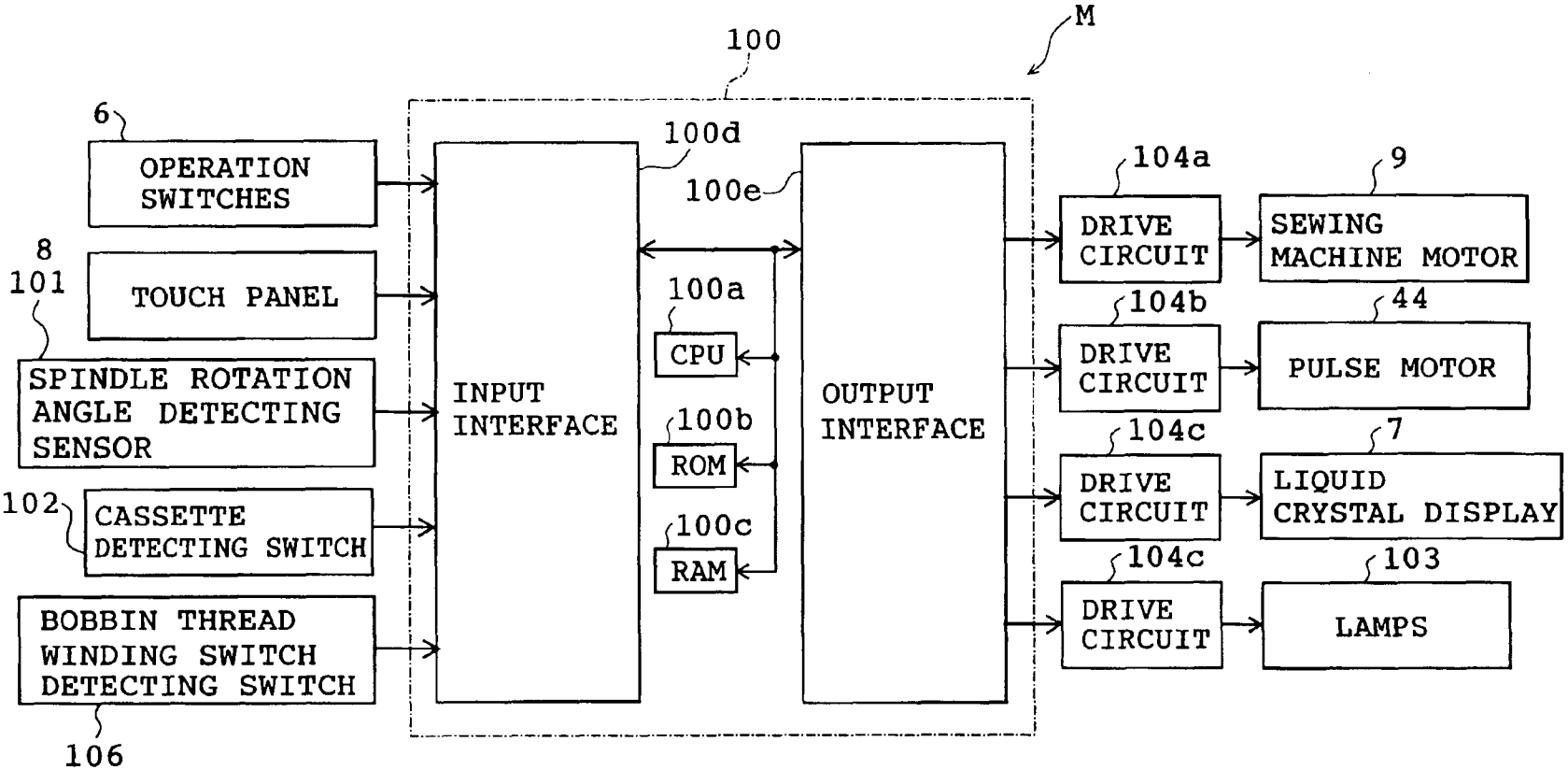
FIG. 17 is a block diagram showing an electrical arrangement of the control system of the sewing machine.

The control system of the sewing machine M will now be described. Referring to FIG. 17, a control device 100 of the sewing machine M comprises a microcomputer including CPU 100*a*, ROM 100*b*, RAM 100*c* an input interface 100*d* and an output interface 100*e*. To the input interface 100*d* are electrically connected the operation switches 6, the touch panel 8, the spindle rotation angle detecting sensor 101, the cassette detecting switch 102 and the winding switch detecting switch 106. To the output interface 100*e* are electrically connected drive circuits 104*a* to 104*e* for driving the sewing machine motor 9, pulse motor 44, liquid crystal display 7, lamps 103 and LED 105 respectively.

Figure 18:
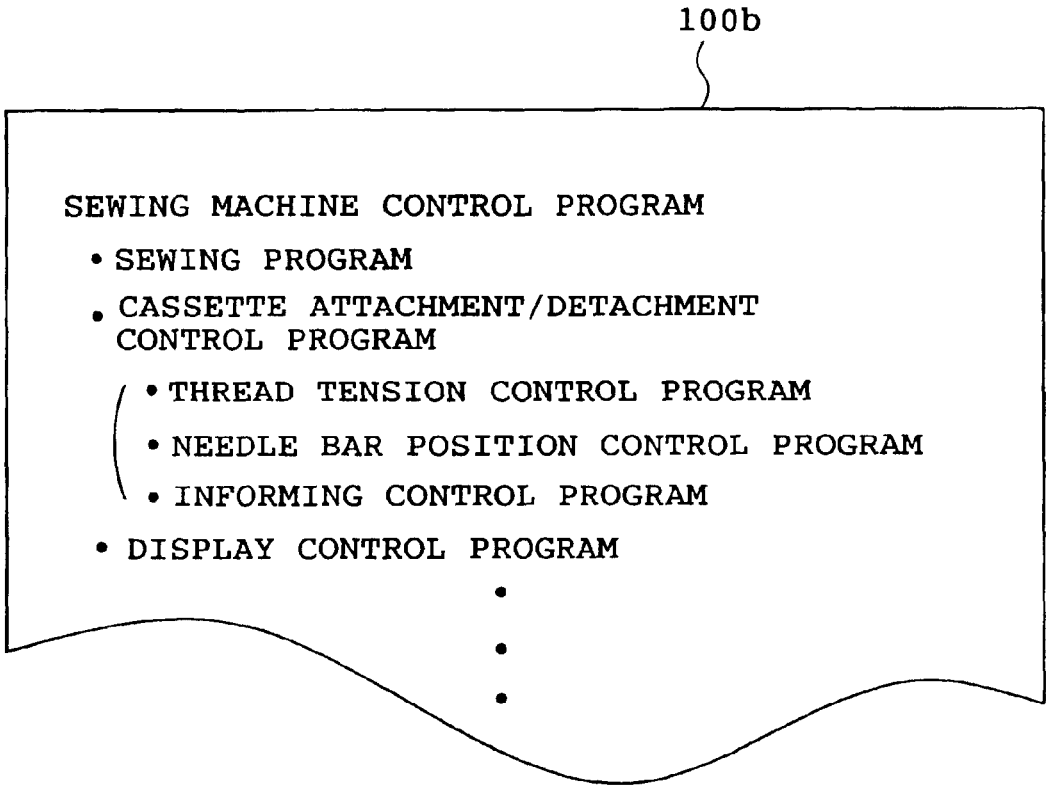
FIG. 18 illustrates a program stored in ROM of a control device.

ROM 100*b* stores a control program for the sewing machine M as shown in FIG. 18. The control program includes a sewing control program for executing a normal sewing operation, a cassette attachment/detachment control program including a thread tension control program for attaching and detaching the thread cassette 10 to and from the cassette mount 5, a needle bar position control program and an informing control program.

Upon execution of the control program, the control device 100 determines whether the thread cassette 10 can be attached to the cassette mount 5, based on an operating state of a mechanism related with the thread cassette 10, when detachment or non-attachment of the thread cassette 10 from or to the cassette mount 5 has been detected by the cassette detecting switch 102. Based on the results of determination, the control device 100 controls turn-on and turn-off of LED 105. Particularly in the embodiment, the aforesaid mechanism related with the thread cassette 10 includes mechanisms affecting executability of threading by the threading mechanism 16B. More specifically, the control device 100 detects states of the needle bar vertically moving mechanism 18, needle bar rocking mechanism 19 and thread tensioning mechanism 14. The control device 100 determines that the thread cassette 10 can be attached to the cassette mount 5 when the thread can be passed through the needle hole 12*b*, or more specifically, when the needle bar 12 is located at a predetermined vertical position or a position near the needle top (20 to 50 degrees in the spindle angle) and is further located at a predetermined zigzag position or left needle position and the thread tensioning mechanism 14 is in the open state. The control device 100 obtains an angle of rotation (an amount of drive) of the pulse motor 44 serving as a common driving mechanism section for driving the thread tensioning mechanism 14 and the needle bar rocking mechanism 19, thereby detecting an open or closed state of the thread tensioning mechanism 14 and a zigzag position of the needle bar 12.

In the case where the bobbin thread winding operation is being detected by the bobbin thread winding switch detecting switch 106 even during drive of the motor 9, the control device 100 determines that the thread cassette 10 can be attached to the cassette mount 5, if the aforesaid other conditions are met. When determining that the thread cassette 10 can be attached to the cassette mount 5, the control device 100 turns on LED 105. The control device 100 turns off LED 105 when determining that the thread cassette 10 cannot be attached to the cassette mount 5 and when the thread cassette 10 has already been attached to the cassette mount 5. Accordingly, the control device 100 serves as a determining unit and constitutes a part of a detector and a part of an informing unit.

When the thread tension control program and the needle bar position control program are executed and ejection of the thread cassette is detected by the cassette detecting switch 102, the control device 100 controls the needle bar rocking mechanism 19 (the pulse motor 44) so that the needle bar 12 is rocked to a predetermined zigzag position or left needle position where the needle can be threaded by the thread feeding mechanism 16A and the threading mechanism 16B. With this, the control device 100 controls the thread tensioning mechanism 14 (the pulse motor 44) so that the thread tension discs 41 and 42 are opened, when detachment of the thread cassette 10 from the cassette mount 5 has been detected by the cassette detecting switch 102. When ejection of the thread cassette 10 from the cassette mount 5 has been detected by the cassette detecting switch 102, the control device 100 stops the needle bar 12 at a position where threading can be performed and which is near the needle top, based on the results of detection by the spindle rotation angle detecting sensor 101. More specifically, the needle bar 12 is stopped at a position corresponding to any rotation angle of the spindle ranging from 20 to 50 degrees, for example, 45 degrees.

Figure 19:
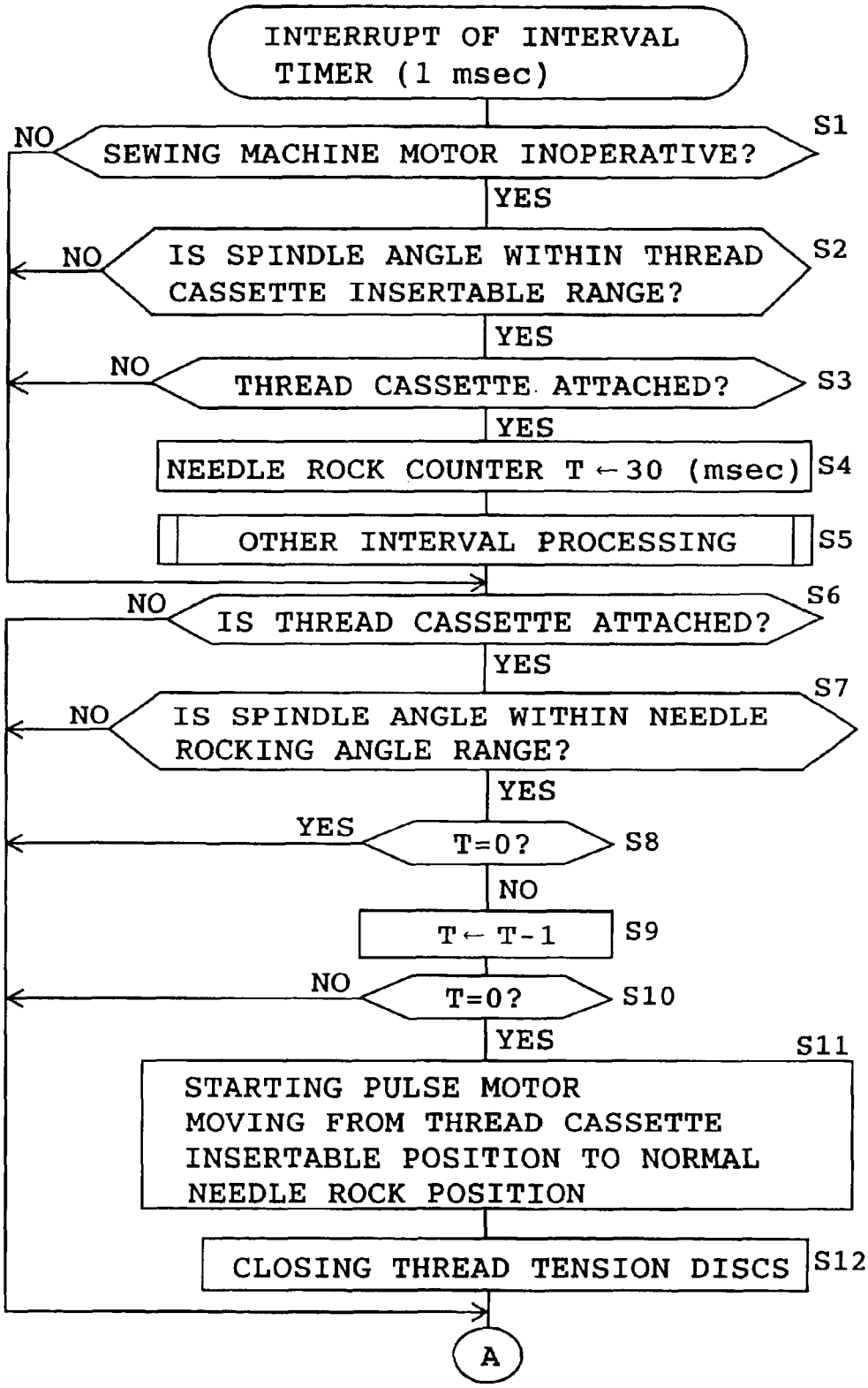
FIG. 19 is a first half of flowchart showing procedures of processing for attachment and detachment of the thread cassette carried out by the control device.
Figure 20:
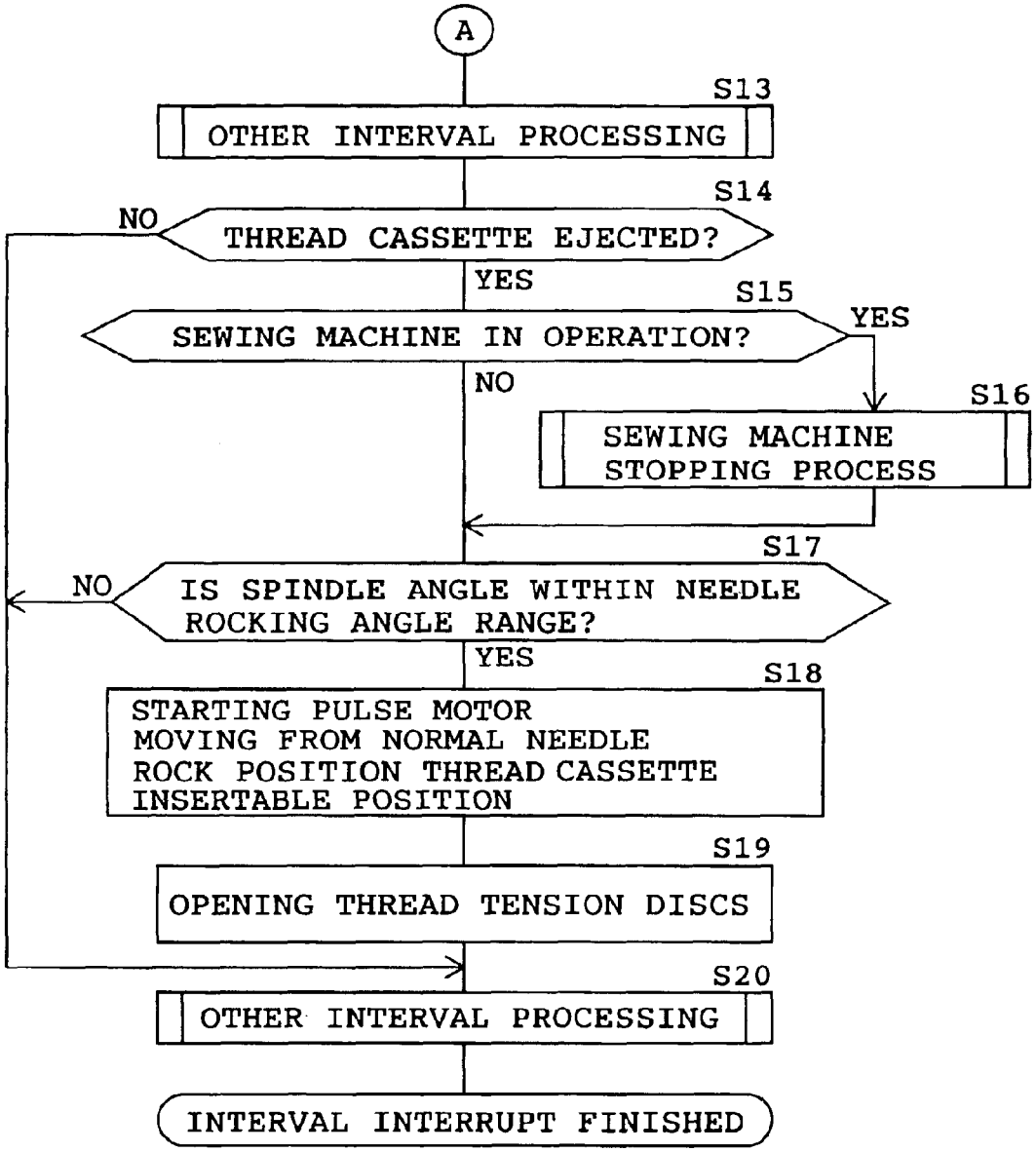
FIG. 20 is a second half of flowchart showing procedures of processing for attachment and detachment of the thread cassette carried out by the control device.

FIGS. 19 and 20 show the control carried out by the control device 100 and including the thread tension control program and the needle bar position control program. As shown in FIG. 19, the control starts with an interrupt at intervals of 1 msec. and the control device 100 advances to step S2 when the sewing machine motor 9 is turned off (step S1). When the spindle angle is within a thread cassette insertable angular range (YES at step S2), the control device 100 advances to step S3. When determining that the thread cassette 10 has been attached to the cassette mount 5 with turn-on of the cassette detecting switch 102 (YES at step S3), the control device 100 advances to step S4 to set the zigzag counter T at 30 (msec), then advancing to step S5. The control device 100 advances directly to step S5 when determination is made in the negative at each of steps S i to S3. In the other interval processing at step S5, the control device 100 executes scan of pattern keys and the like, read of speed volume and read of speed of the sewing machine motor 9.

The rotation angle of the spindle is obtained by operation on the basis of information supplied by the spindle rotation angle sensor 101 comprising an encoder. In this case, a rotation angle of the spindle in the case where the needle bar 12 is at the needle top which is an upper limit position is set at 0 degrees (360 degrees). The thread cassette insertable angle ranges from 20 to 50 degrees, for example.

When the thread cassette 10 is attached to the cassette mount 5 and accordingly, the cassette detecting switch 102 is in the ON-state after the other interval processing at step S5 (YES at step S6), the control device 100 advances to step S7. The control device 100 advances to step S8 when the spindle angle is within a zigzag angle range (YES at step S7). The zigzag angle range may be basically an angular range in which the needle 12*a* is located above the needle plate la and is previously ranged from 280 to 75 degrees.

When the count of the zigzag counter T is not 0 (NO at step S8), the control device 100 advances to step S9 to decrement the counter T to (T−1), further advancing to step S10. When the counter of the zigzag counter T is 0 (YES at step S10), the control device 100 advances to step S11. The control device 100 advances to step S13 when determination is made in the negative at each of steps S6 to S8 and S10.

When determination is made in the affirmative at step S10, the pulse motor 44 is driven so that the cam member 13 is rotated to the position as shown in FIG. 13A at step S11, whereupon the needle bar 12 is moved from the thread cassette insertable position corresponding to the left needle position and a position where the needle 12 can desirably be threaded by the threading mechanism 16B to a normal zigzag position or a neutral position where the needle bar is vertical. With this, the paired thread tension discs 41 and 42 are closed at step S12, and the control device 100 then advances to step S14.

When the cassette detecting switch 102 is turned off after the other interval processing at step S13, the control device 100 determines that the thread cassette 10 has been ejected from the cassette mount 5 (YES at step S14), as shown in FIG. 20. The control device 100 then carries out a stopping process for the sewing machine motor 9 (step S16) to stop the needle bar up-down moving mechanism 18. In this case, the sewing machine motor 9 is stopped when the rotation angle of the spindle ranges from 20 to 50 degrees, for example, is at 45 degrees. The control device 100 advances to step S18 when the spindle angle is within the aforesaid zigzag angle range (YES at step S17).

The pulse motor 44 is driven at step S18 so that the cam member 13 is rotated to the position as shown in FIG. 12A, whereby the needle bar 12 is moved from the normal zigzag position to the thread cassette insertable position (the left needle position corresponding to the predetermined zigzag position). With this movement, the control device 100 opens the thread tension discs 41 and 42 at step S19 and thereafter carries out the other interval processing (S20), thereby ending the control. When determining in the negative at each of steps S14 and S17, the control device 100 advances to step S20.

Thus, when the ejection of the thread cassette 10 from the cassette mount 5 has been detected by the cassette detecting switch 102, the needle bar 12 is rocked to the predetermined zigzag position (the left needle position) where the needle 12 can be threaded by the threading mechanism 16B and the thread tensioning mechanism 14 is opened. Furthermore, the needle bar 12 is stopped at the predetermined vertical position where the threading can be performed, whereby the thread cassette 12 is prepared for the subsequent attachment.

Figure 21:
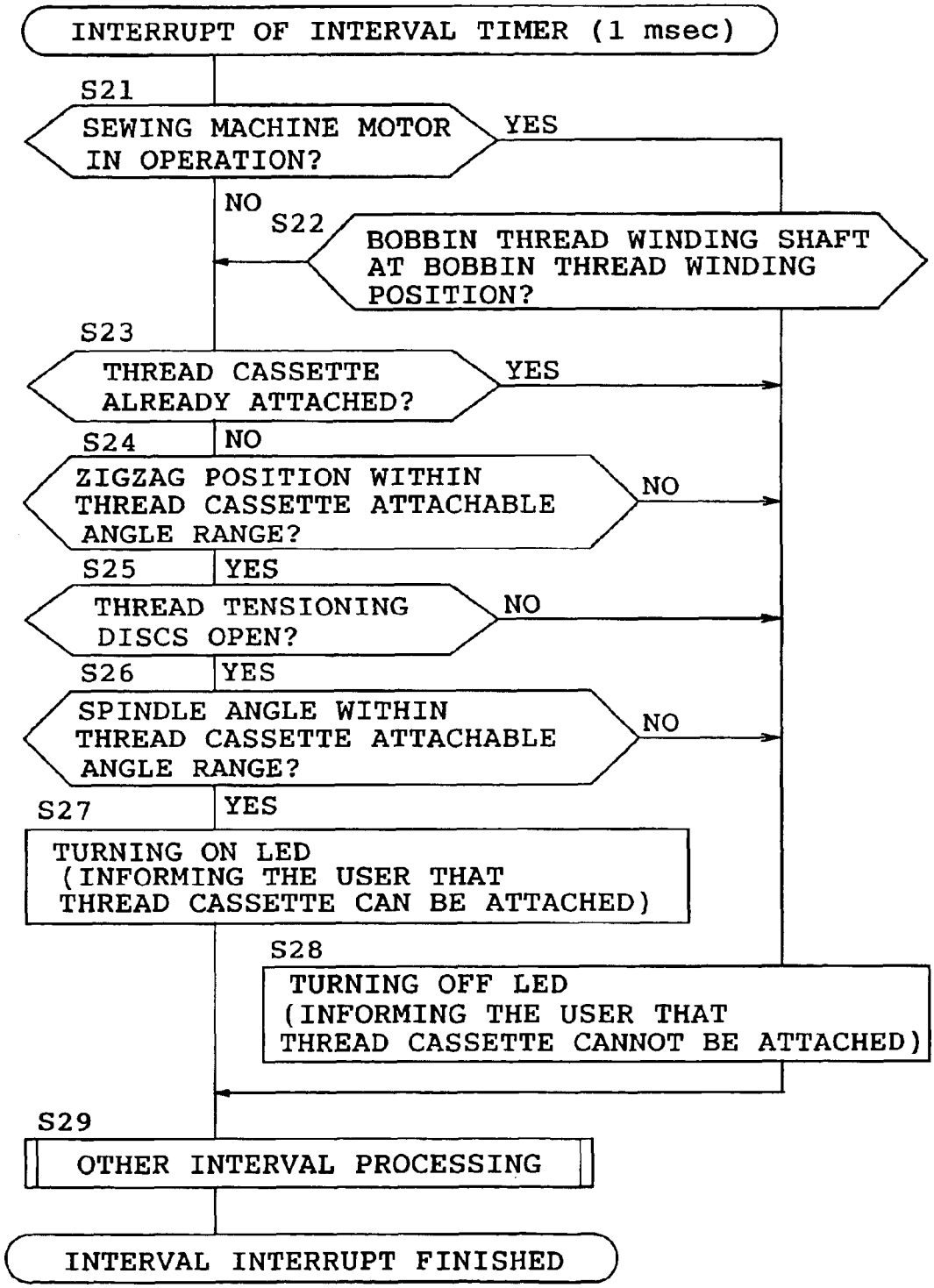
FIG. 21 is a flowchart showing procedures of processing for informing control carried out by the control device.

The control including the informing control program carried out by the control device 100 will now be described with reference to FIG. 21. As shown in FIG. 21, the control starts with an interrupt at intervals of 1 msec. and firstly, the control device 100 determines whether the sewing machine motor 9 is in operation (step S21). The control device 100 advances to step S23 when the motor 9 is not in operation (NO at step S21). When the motor 9 is in operation (YES at step S21), the control device 100 determines the position of the bobbin thread winding shaft. The control device 100 advances to step S23 when the shaft is at the bobbin thread winding position (YES at step S22). When the shaft is not at the bobbin thread winding position or the bobbin thread winding operation is being detected (NO at step S22), the control device 100 determines that sewing is being carried out, advancing to step S28.

When determining that sewing is not being carried out (NO at step S20; or YES at step S21), the control device 100 determines whether the thread cassette 10 has been attached to the cassette mount 5, based on the signal from the cassette detecting switch 102. When the cassette detecting switch 102 is off and the thread cassette 10 is not attached to the cassette mount 5 (NO at step S23), the control device 100 determines whether the zigzag position of the needle bar 12 is at the position where the thread cassette can be attached to the cassette mount 5, which position corresponds to a predetermined zigzag position in the invention.

When the spindle angle is within the thread cassette insertable angle (ranging from 20 to 50 degrees) (YES at step S26) or when the needle bar 12 is at the predetermined vertical position, the control device 100 turns on LED 105 (step S27) thereby to inform the user that the thread cassette 10 can be attached to the cassette mount 5. On the other hand, when the thread cassette 10 has already been attached to the cassette mount 5 (YES at step S23) or when determination is made in the negative at any one of steps S24 to S26, the control device 100 turns off LED 105 (step S28) thereby to inform the user that the thread cassette 10 cannot be attached to the cassette mount.

Furthermore, the control device 100 determines that the thread cassette 10 has been attached to the cassette mount 5 (YES at step S23) when LED 105 is on and the cassette detecting switch 104 is also on. Then, LED 105 is turned off (step S28), thereby informing the user that the thread cassette 10 can be attached to the cassette mount 5. Thereafter, the control device 100 carries out the other interval processing (step S29), completing the processing.

In the foregoing sewing machine M, the control device 100 automatically determines whether the thread cassette 10 can (or may) be attached to the cassette mount 5, based on the operating state of the mechanism related with the thread cassette 10. The result of determination is informed by turn-on and turn-off of LED 105. Based on the information, the user attaches the thread cassette 10 to the cassette mount 5 when the thread cassette is attachable. Consequently, attachment of the thread cassette 10 can be prevented in the case where the thread cassette should not be attached.

Particularly in the foregoing embodiment, when the zigzag position and vertical position of the needle bar 12 and the state of the thread tensioning mechanism 14 are suitable for passing the thread 11 through the needle hole 12*b* by the threading mechanism 16B or setting the thread 11, the control device 100 determines that the thread cassette 10 can be attached to the cassette mount 5, and turns on LED 105 to inform of the result of determination. Accordingly, malfunction and damage of the threading mechanism 16B and a false setting of the thread 11 can be prevented, and the threading operation or the setting of the thread 11 can reliably carried out.

When the thread cassette 10 is not attached to the cassette mount 5 and LED 105 is not turned on, at least any one of the zigzag position and vertical position of the needle bar 12 and the state of the thread tensioning mechanism 14 is considered to be unsuitable. In the embodiment, when the thread cassette 10 was ejected from the cassette mount 5 in the previous sewing, the needle bar 12 was stopped at the predetermined zigzag position (needle position) and the thread tensioning mechanism 14 was opened (or the pulse motor 44 was stopped at a predetermined position). In other words, a major cause for LED's not being turned off is an unsuitable vertical position of the needle bar 12 in most cases. Accordingly, in the case where LED 105 is not turned on under the condition where the thread cassette 10 is not attached to the cassette mount 5, the user manually rotates the manual pulley 33 so that the spindle angle and accordingly, the vertical position of the needle bar 12 are adjusted, for example, whereby the vertical position of the needle bar can be rendered suitable (or the spindle angle ranges from 20 to 50 degrees). Consequently, LED 105 can be turned on.

Modified forms will now be described. The thread cassette in the embodiment is a mere example. The thread need not be wound on the spool. As another applicable thread cassette, a mass of thread serving as the thread supply may be accommodated in the accommodating section. Furthermore, at least one of the walls surrounding the thread accommodating section may be eliminated so that the thread spool can be held on a holding portion of a spool pin.

The pulse motor 44 may not be an actuator common to the thread tensioning mechanism 14 and the needle bar rocking mechanism 19. These mechanisms 14 and 19 may be provided with individual actuators such as electric motors respectively, instead. In this construction, when the user has changed the setting of the thread tension, the actuator for the thread tensioning mechanism may be operated so that the changed thread tension is set. More specifically, the thread may be released from tension at the time of ejection of the thread cassette using an actuator automatically changing the thread tension for the sewing. In this case, two detectors are provided for detecting the zigzag position of the needle bar 12 and the open or closed state of the thread tensioning mechanism 14 respectively.

In the foregoing embodiment, LED 105 is turned on to positively inform the user that the thread cassette can be attached to the cassette mount 5. LED 105 may be turned on to inform the user that the thread cassette cannot be attached to the cassette mount 5, instead.

Figure 22:
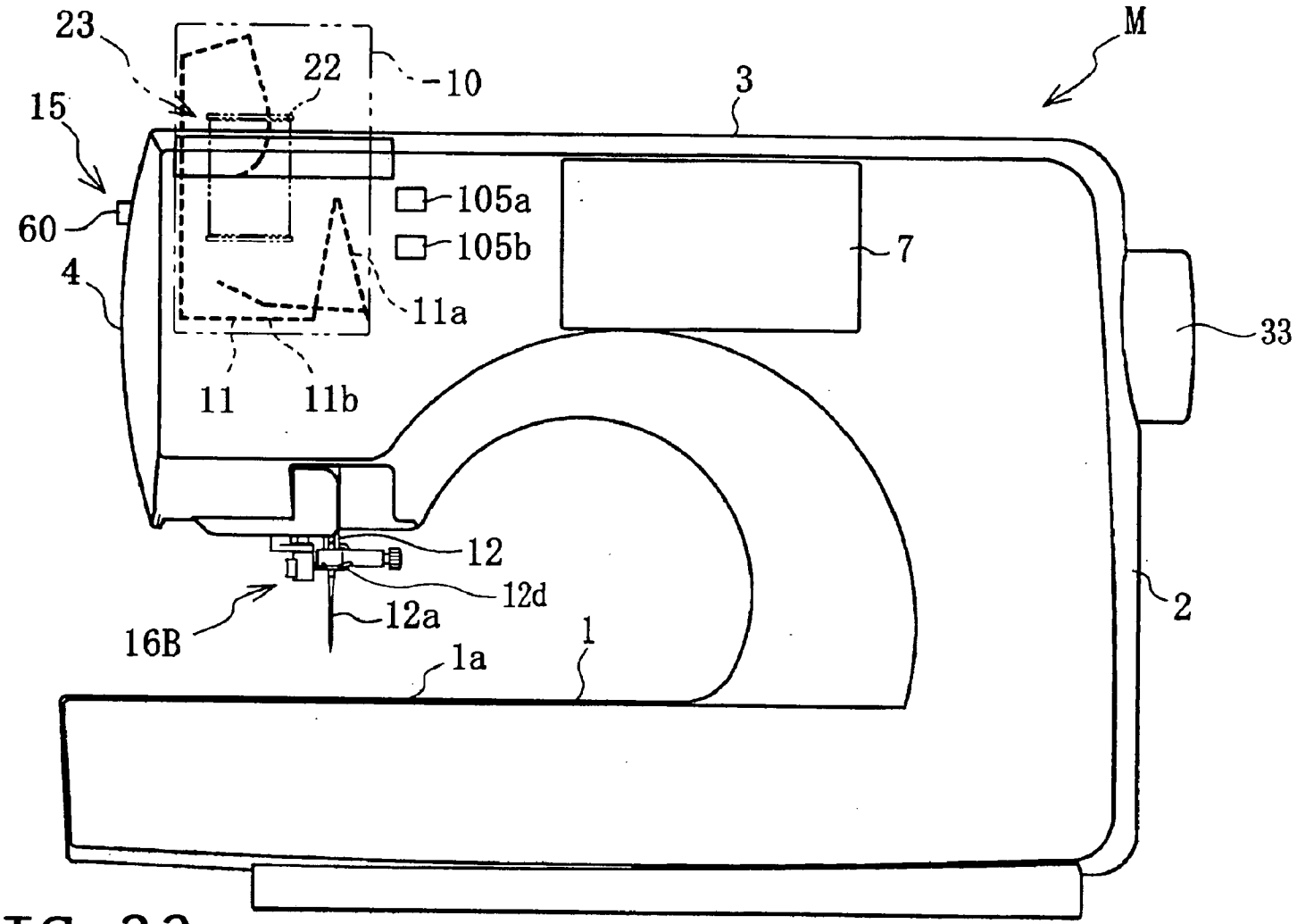
FIG. 22 is a view similar to FIG. 1, showing a second embodiment of the present invention.

Two LED's 105*a* and 105*b* emitting light of different colors may be provided near the cassette mount 5 of the sewing machine M as shown as a second embodiment in FIG. 22. In this case, for example, a blue LED 105*a* is turned on to inform the user that the thread cassette 10 can be attached to the cassette mount 5. A red LED 105*b* is turned on to inform the user that the thread cassette 10 cannot be attached to the cassette mount 5. Furthermore, character indications of "CASSETTE ATTACHABLE" and "DO NOT ATTACH CASSETTE" may be provided near LED's 105*a* and 105*b* so as to correspond to them in order that the user may understand the meaning of emitted light more clearly. Additionally, a buzzer including a loudspeaker may be provided as audio informing means, instead of LED 105 having a light emitting section.

Figure 23A:
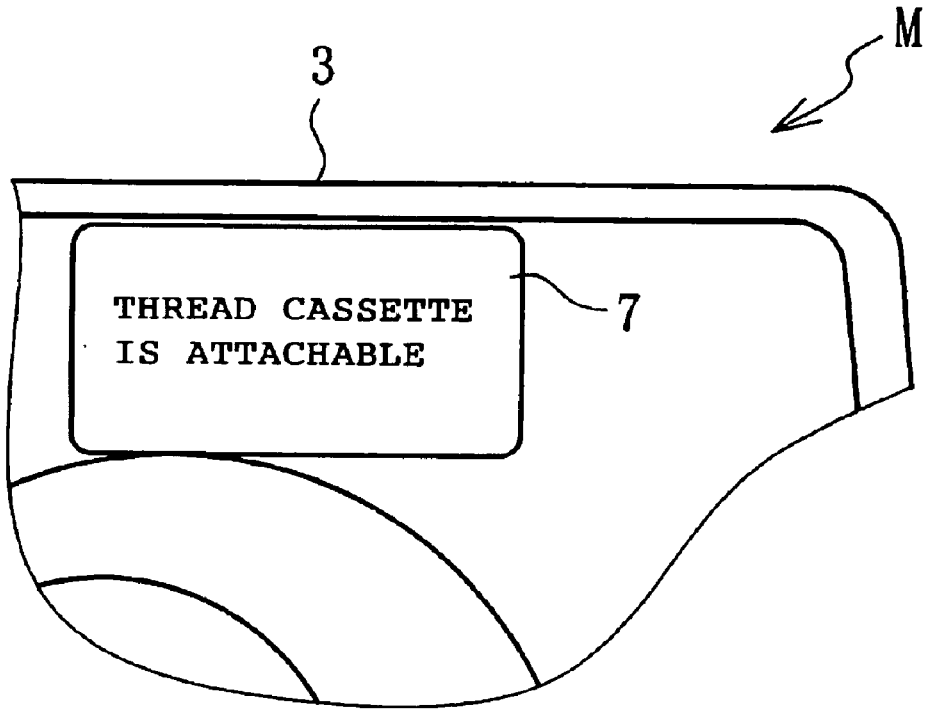
FIGS. 23A and 23B are front views of the liquid crystal display in the case where the thread cassette can be attached to the cassette mount and in the case where the thread cassette cannot be attached, in a third embodiment of the present invention.
Figure 23B:
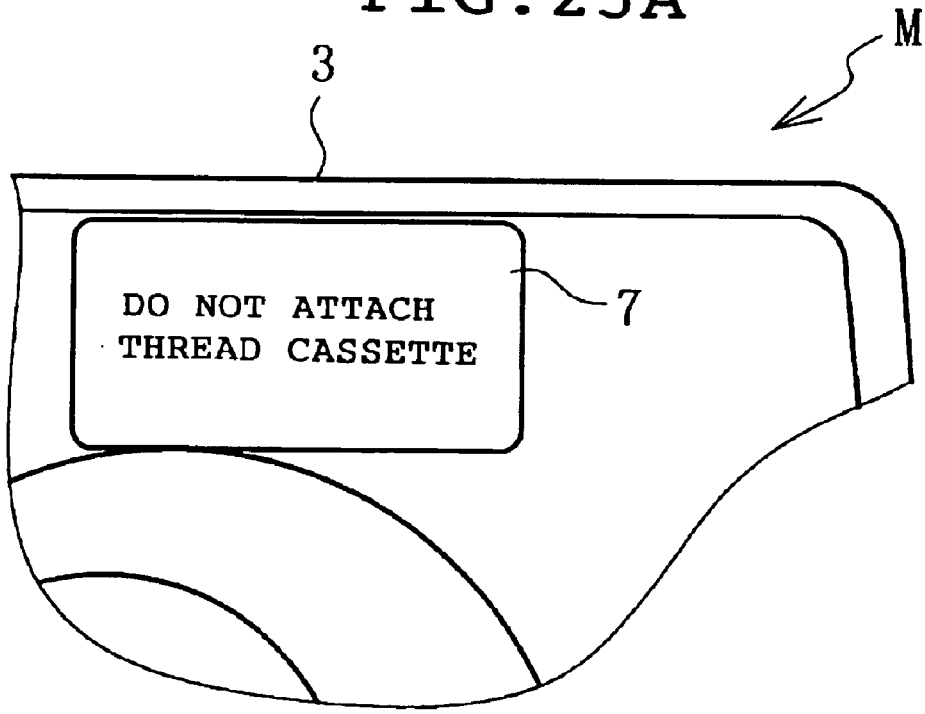

A display 7 may be provided as the informing unit (display unit) as shown as a third embodiment in FIGS. 23A and 23B. When the thread cassette 10 can be attached to the cassette mount 5, the display 7 may display a character message, "THREAD CASSETTE CAN BE ATTACHED" as shown in FIG. 23A. On the other hand, when the thread cassette 10 cannot be attached to the cassette mount 5, the display 7 may display a character message, "THREAD CASSETTE CANNOT BE ATTACHED" as shown in FIG. 23B.

The aforesaid predetermined zigzag position is not necessarily the left needle position of the needle bar 12 but may be set at another position. In this case, however, it is needless to say that the locations of the thread feeding mechanism 16A and threading mechanism 16B and the like need to be set so that the thread 11 drawn from the thread cassette 10 can reliably be passed through the needle hole 12*b* by these mechanisms when the thread cassette 10 is attached to the cassette mount 5 with the needle bar 12 being located at the predetermined zigzag position.

Figure 24:
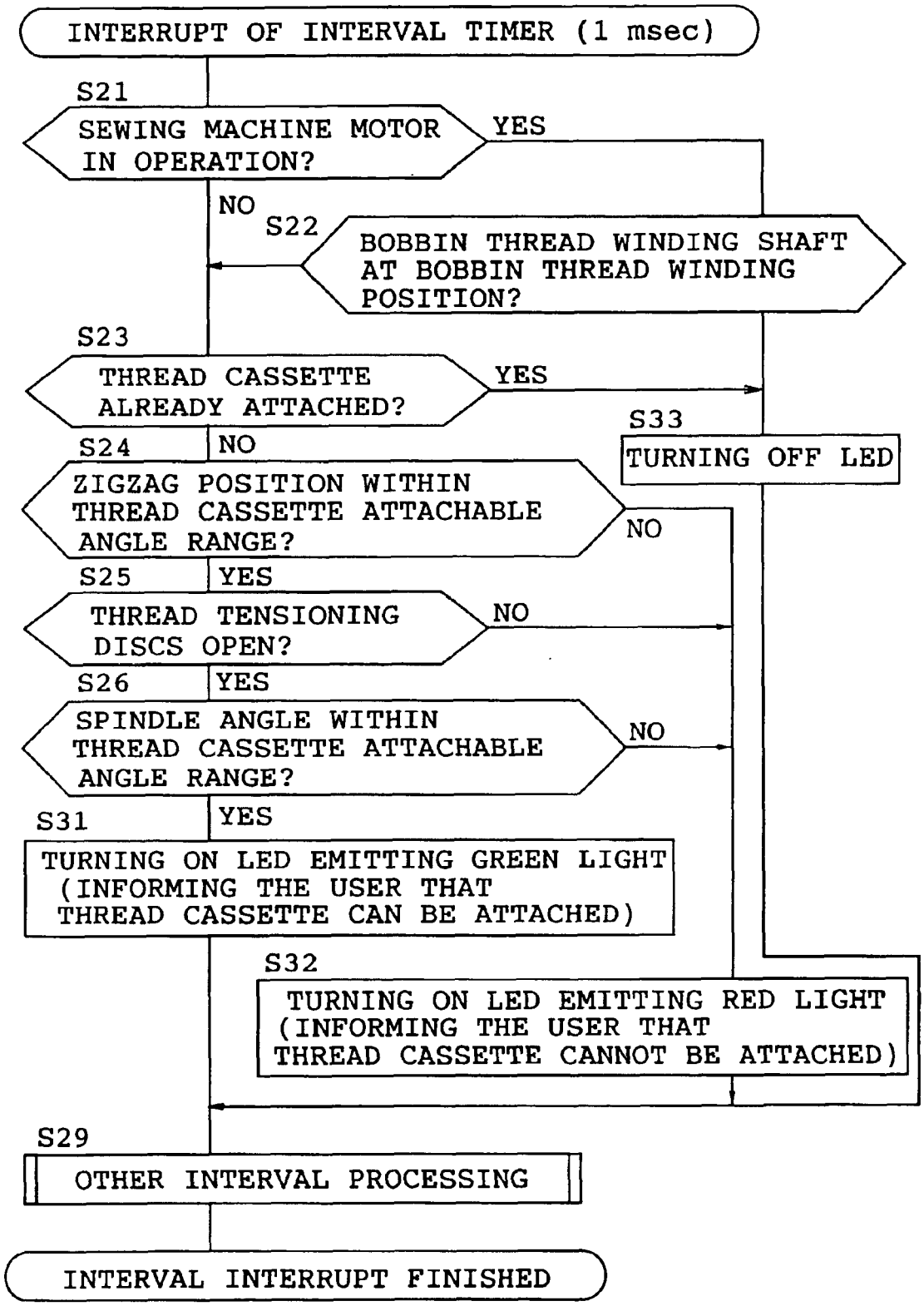
FIG. 24 is a view similar to FIG. 21, showing a fourth embodiment of the present invention.

A single LED emitting two colors of light may be employed as the informing unit. As shown as a fourth embodiment in FIG. 24, when the thread cassette 10 can be attached to the cassette mount 5 (YES at step S26), LED is turned on to emit green light (step S31). When the thread cassette 10 cannot be attached to the cassette mount 5 (NO at any one of steps S24 to S26), LED is turned on to emit red light (step S32). When the thread cassette 10 has already been attached to the cassette mount 5 NO at step S22; or YES at step S23), LED is turned off (step S33).

The cassette attachment/detachment control program including the informing control program, which is stored in ROM 100*b* of the control device 100, can be applied to sewing machines of the types similar to the sewing machine M. Accordingly, the cassette attachment/detachment control program or the informing control program may be supplied to users via communication means such as an internet or with a recording medium such as CD, MD or FD.

In the foregoing embodiment, the thread cassette 10 is manually pushed down to the lowermost position in the cassette mount 5. However, the invention may be applied to a sewing machine in which the thread cassette is automatically led into the lowermost position by rubber rollers, instead. The rubber rollers are rotated by an actuator such as a pulse motor. An origin needs to be detected in such an actuator. In this case, the detection of origin is supposed to be carried out under a small load condition where nothing is brought into contact with the rubber rollers. Accordingly, if the thread cassette 10 should be inserted into the cassette mount 5 before the detection of origin and the rubber rollers should be brought into contact with the thread cassette 10, load applied to the actuator would become larger than supposed. As a result, there is a possibility that normal origin detection cannot be carried out. Alternatively, there is a possibility that the origin detection may take an excessive amount of time or electric power as compared with the case where the thread cassette 10 has not been attached to the cassette mount 5.

In the foregoing embodiment, however, the thread cassette 10 can be attached to the cassette mount properly when whether the thread cassette can be attached is informed. More specifically, the sewing machine is programmed so that LED 105 is turned on after detection of origin of the actuator. Thus, the aforesaid disadvantage can be overcome when an operating state of the mechanism related with the thread cassette 10 is detected and a predetermined informing operation is carried out on the result of detection.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing apparatus having a cassette mount to which a thread cassette having a thread accommodating section for accommodating a thread supply is detachably attached, the sewing apparatus comprising:

at least one detector detecting an operating state of at least one mechanism related with the thread cassette;

a determining unit determining whether the thread cassette can be attached to the cassette mount, based on a result of detection by the detector; and an informing unit informing a result of determination by the determining unit.

2. A sewing apparatus according to claim 1, further comprising a threading mechanism for passing, through a hole of a sewing needle, a thread drawn from the thread cassette attached to the cassette mount, wherein the detector includes a threading detector detecting a state of a mechanism affecting executability of a threading operation by the threading mechanism, and when the thread can be passed through the hole of the needle, the determining unit determines that the thread cassette can be attached to the cassette mount, based on a result of detection by the threading detector.

3. A sewing apparatus according to claim 1, further comprising a needle bar vertically moving mechanism for moving the needle bar vertically, wherein the detector includes a needle bar vertical position detector detecting a vertical position of the needle bar, and when the needle bar is at a predetermined vertical position, the determining unit determines that the thread cassette can be attached to the cassette mount, based on a result of detection by the needle bar vertical position detector.

4. A sewing apparatus according to claim 1, further comprising a needle bar rocking mechanism rocking the needle bar, wherein the detector includes a zigzag position detector detecting a zigzag position of the needle bar, and when the needle bar is at a predetermined zigzag position, the determining unit determines that the thread cassette can be attached to the cassette mount, based on a result of detection by the zigzag position detector.

5. A sewing apparatus according to claim 1, further comprising a thread tensioning mechanism adjusting a thread tension of the thread drawn from the thread cassette, wherein the detector includes a thread tension detector detecting an open or closed state of the thread tensioning mechanism, and when the thread tensioning mechanism is open, the determining unit determines that the thread cassette can be attached to the cassette mount, based on a result of detection by the thread tension detector.

6. A sewing apparatus according to claim 1, further comprising a needle bar rocking mechanism, a thread tensioning mechanism adjusting a tension of the thread drawn from the thread cassette, and a single driving mechanism driving both needle bar rocking mechanism and thread tensioning mechanism, wherein the detector includes a zigzag position detector detecting a zigzag position of the needle bar and a thread tension detector detecting an open or closed state of the thread tensioning mechanism, and the zigzag position of the needle bar and the open or closed state of the thread tensioning mechanism are detected on the basis of a drive amount of the driving mechanism.

7. A sewing apparatus according to claim 1, further comprising a sewing machine motor, a bobbin, a bobbin thread winding shaft on which the bobbin is mounted and a bobbin thread winding mechanism transmitting a driving force of the sewing machine motor to the bobbin thread winding shaft so that a bobbin thread is wound on the bobbin, wherein the detector includes a thread winding detector detecting an operating state of the bobbin thread winding mechanism, and when the bobbin thread winding mechanism is in operation, the determining unit determines that the thread cassette can be attached to the cassette mount, based on a result of detection by the thread winding detector.

8. A sewing apparatus according to claim 1, wherein the informing unit is provided with a display unit displaying whether the thread cassette can be attached to the cassette mount, and the display unit is disposed near the cassette mount.

9. A sewing apparatus according to claim 1, further comprising a cassette detector detecting the thread cassette having been attached to the thread cassette, wherein the informing unit stops informing that the thread cassette can be attached, when attachment of the thread cassette to the cassette mount has been detected by the cassette detector.

10. A sewing apparatus according to claim 1, wherein the informing unit is provided with a lamp unit which changes a color of light, thereby informing whether the thread cassette can be attached to the cassette mount.

11. A sewing apparatus according to claim 10, further comprising a cassette detector detecting the thread cassette having been attached to the thread cassette, wherein the informing unit turns off the lamp when attachment of the thread cassette to the cassette mount has been detected by the cassette detector.

12. A sewing apparatus according to claim 1, wherein the informing unit informs whether the thread cassette can be attached to the cassette mount, by means of a character message.

13. An informing control program for a sewing apparatus including a cassette mount to which a thread cassette having a thread accommodating section for accommodating a thread supply is detachably attached and at least one detector detecting an operating state of at least one mechanism related with the thread cassette, the program informing, on a computer, whether the thread cassette can be attached to the cassette mount, the program accomplishing the functions of:

a determining unit determining whether the thread cassette can be attached to the cassette mount, based on a result of detection by the detector; and an informing unit informing a result of determination by the determining unit.

* * * * *